US012201865B2

(12) United States Patent
Lagree

(10) Patent No.: US 12,201,865 B2
(45) **Date of Patent: *Jan. 21, 2025**

(54) EXERCISE MACHINE SUPPORT SYSTEM

(71) Applicant: Lagree Technologies, Inc., Chatsworth, CA (US)

(72) Inventor: Sebastien Anthony Louis Lagree, Chatsworth, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 64 days.

This patent is subject to a terminal disclaimer.

(21) Appl. No.: 18/305,694

(22) Filed: Apr. 24, 2023

(65) Prior Publication Data

US 2023/0249022 A1 Aug. 10, 2023

Related U.S. Application Data

(63) Continuation of application No. 17/884,050, filed on Aug. 9, 2022, now Pat. No. 11,666,792, which is a (Continued)

(51) Int. Cl.
*A63B 21/00* (2006.01)
*A63B 21/005* (2006.01)
(Continued)

(52) U.S. Cl.
CPC .... *A63B 21/00069* (2013.01); *A63B 21/0058* (2013.01); *A63B 21/008* (2013.01);
(Continued)

(58) Field of Classification Search
CPC ..... A63B 21/00058; A63B 21/00061; A63B 21/00065; A63B 21/00069;
(Continued)

(56) References Cited

U.S. PATENT DOCUMENTS 1,621,477 A 3/1927 Pilates
1,866,868 A 7/1932 Thomson
(Continued)

FOREIGN PATENT DOCUMENTS

EP 0354785 A2 2/1990
KR 101226434 B1 1/2013
(Continued)

OTHER PUBLICATIONS

PCT International Search Report for PCT/US2015/033463; Sep. 1, 2015.
(Continued)

*Primary Examiner* — Gary D Urbiel Goldner
(74) *Attorney, Agent, or Firm* — Neustel Law Offices

(57) ABSTRACT

An exercise machine support system for providing increased versatility including inclination or declination of an exercise surface, a reduction in the overall length and width of the exercise machine, and an enhanced user interface which reduces the risk of injury. The exercise machine support system generally includes a cantilevered exercise machine which is adapted to have a variable angle of incline or decline with respect to a horizontal ground surface. The exercise machine will generally include a base and a support which extends between the base and the exercise machine. The upper end of the support is connected to the exercise machine by a first pivot such that the exercise machine pivots about the support. An adjustment device may be utilized to pivot the exercise machine and thus adjust its angle of incline. Various types of adjustment devices are disclosed, including an actuator, ratchet-and-pawl, gears, and cam.

15 Claims, 16 Drawing Sheets

Related U.S. Application Data continuation of application No. 17/198,435, filed on Mar. 11, 2021, now Pat. No. 11,413,488, which is a continuation of application No. 16/403,608, filed on May 5, 2019, now Pat. No. 10,946,230, which is a continuation of application No. 15/376,600, filed on Dec. 12, 2016, now Pat. No. 10,279,207, which is a continuation of application No. 14/742,106, filed on Jun. 17, 2015, now Pat. No. 9,517,375.

(60) Provisional application No. 62/090,077, filed on Dec. 10, 2014, provisional application No. 62/013,028, filed on Jun. 17, 2014.

(51) Int. Cl.

| | |
|---|---|
| ***A63B 21/008*** | (2006.01) |
| ***A63B 21/02*** | (2006.01) |
| ***A63B 21/04*** | (2006.01) |
| ***A63B 21/055*** | (2006.01) |
| ***A63B 21/068*** | (2006.01) |
| ***A63B 22/00*** | (2006.01) |
| ***A63B 22/20*** | (2006.01) |
| ***A63B 23/00*** | (2006.01) |
| ***A63B 23/02*** | (2006.01) |
| ***A63B 23/035*** | (2006.01) |
| ***A63B 23/04*** | (2006.01) |
| ***A63B 23/12*** | (2006.01) |
| ***A63B 24/00*** | (2006.01) |

(52) U.S. Cl.

CPC ..... *A63B 21/0085* (2013.01); *A63B 21/023* (2013.01); *A63B 21/0428* (2013.01); *A63B 21/0552* (2013.01); *A63B 21/068* (2013.01); *A63B 21/4031* (2015.10); *A63B 21/4035* (2015.10); *A63B 21/4047* (2015.10); *A63B 22/0012* (2013.01); *A63B 22/0023* (2013.01); *A63B 22/0046* (2013.01); *A63B 22/0056* (2013.01); *A63B 22/0087* (2013.01); *A63B 22/208* (2013.01); *A63B 24/0084* (2013.01); *A63B 24/0087* (2013.01); *A63B 21/00061* (2013.01); *A63B 21/00065* (2013.01); *A63B 21/0083* (2013.01); *A63B 21/0087* (2013.01); *A63B 21/0442* (2013.01); *A63B 21/4043* (2015.10); *A63B 22/0089* (2013.01); *A63B 22/203* (2013.01); *A63B 22/205* (2013.01); *A63B 2023/003* (2013.01); *A63B 23/0211* (2013.01); *A63B 23/03541* (2013.01); *A63B 23/047* (2013.01); *A63B 23/1209* (2013.01); *A63B 2024/0093* (2013.01); *A63B 2208/0204* (2013.01); *A63B 2208/0214* (2013.01); *A63B 2208/0219* (2013.01); *A63B 2208/0242* (2013.01); *A63B 2225/50* (2013.01)

(58) Field of Classification Search

CPC ..... A63B 21/00076; A63B 21/00178; A63B 21/00181; A63B 21/00185; A63B 21/0058; A63B 21/008; A63B 21/0083; A63B 21/0085; A63B 21/0087; A63B 21/02; A63B 21/023; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0615; A63B 21/0616; A63B 21/0617; A63B 21/068; A63B 21/08; A63B 21/15; A63B 21/159; A63B 21/4027; A63B 21/4029; A63B 21/4031; A63B 21/4033; A63B 21/4035; A63B 21/4047; A63B 21/4049; A63B 22/0015; A63B 22/0017; A63B 22/0023; A63B 22/0046; A63B 22/0056; A63B 22/0087; A63B 22/0089; A63B 22/20; A63B 22/201; A63B 22/203; A63B 22/205; A63B 22/208; A63B 24/0087; A63B 2024/0093; A63B 71/0054; A63B 2071/0063; A63B 2071/0072; A63B 2208/0204; A63B 2208/0214; A63B 2208/0219; A63B 2208/0242; A63B 2225/09; A63B 2225/093

See application file for complete search history.

(56) References Cited

U.S. PATENT DOCUMENTS

| | | | | |
|---|---|---|---|---|
| 3,602,501 | A * | 8/1971 | Garner | A63B 23/00 482/145 |
| 3,770,267 | A | 11/1973 | McCarthy | |
| 4,240,627 | A | 12/1980 | Brentham | |
| 4,241,913 | A | 12/1980 | Zwayer | |
| 4,357,010 | A | 11/1982 | Telle | |
| 4,383,684 | A | 5/1983 | Schliep | |
| 4,709,923 | A | 12/1987 | Gibson | |
| 4,759,540 | A | 7/1988 | Yu | |
| 4,798,378 | A | 1/1989 | Jones | |
| 5,035,418 | A | 7/1991 | Harabayashi | |
| 5,058,888 | A | 10/1991 | Walker | |
| 5,064,193 | A | 11/1991 | Sainte | |
| 5,066,005 | A | 11/1991 | Luecke | |
| 5,072,932 | A | 12/1991 | Johnson | |
| 5,209,714 | A | 5/1993 | Sainte | |
| 5,263,913 | A | 11/1993 | Boren | |
| 5,401,226 | A * | 3/1995 | Stearns | A63B 22/203 482/53 |
| D362,700 | S | 9/1995 | Breibart | |
| 5,460,596 | A | 10/1995 | Brady | |
| D382,319 | S | 8/1997 | Gerschefske | |
| 5,681,249 | A | 10/1997 | Endelman | |
| 5,782,639 | A | 7/1998 | Beal | |
| 5,820,478 | A | 10/1998 | Wood | |
| 5,885,197 | A | 3/1999 | Barton | |
| 5,895,340 | A | 4/1999 | Keller | |
| 5,967,955 | A | 10/1999 | Westfall | |
| 6,179,753 | B1 | 1/2001 | Barker | |
| 6,761,667 | B1 | 7/2004 | Cutler | |
| 6,796,927 | B2 | 9/2004 | Toyama | |
| 7,163,498 | B1 | 1/2007 | Abelbeck | |
| 7,163,500 | B2 | 1/2007 | Endelman | |
| 7,270,628 | B2 | 9/2007 | Campanaro | |
| 7,530,929 | B2 | 5/2009 | Feldman | |
| 7,641,597 | B2 | 1/2010 | Schmidt | |
| 7,803,095 | B1 | 9/2010 | Lagree | |
| 7,931,570 | B2 | 4/2011 | Hoffman | |
| 7,935,032 | B1 | 5/2011 | Jackson | |
| 7,998,043 | B2 | 8/2011 | Zhou | |
| 8,012,073 | B2 | 9/2011 | Barnett | |
| 8,192,332 | B2 | 6/2012 | Baker | |
| 8,249,714 | B1 | 8/2012 | Hartman | |
| 8,356,996 | B2 | 1/2013 | Mayrhofer | |
| 8,585,554 | B2 | 11/2013 | Shavit | |
| 8,641,585 | B2 | 2/2014 | Lagree | |
| 8,663,075 | B2 * | 3/2014 | Reyes | A63B 23/0405 482/92 |
| 8,721,506 | B2 | 5/2014 | Gerschefske | |
| 8,734,307 | B2 | 5/2014 | Bathey | |
| 8,764,609 | B1 | 7/2014 | Elahmadie | |
| 8,834,332 | B2 | 9/2014 | Campanaro | |
| 8,858,409 | B2 | 10/2014 | Trees | |
| 8,870,726 | B2 | 10/2014 | Watterson | |
| 9,022,909 | B2 | 5/2015 | Kermath | |
| 9,038,218 | B1 | 5/2015 | Heil | |
| 9,050,517 | B2 | 6/2015 | Oliver | |
| 9,125,785 | B2 | 9/2015 | Trees | |
| 9,132,051 | B2 | 9/2015 | Heil | |

(56) References Cited

U.S. PATENT DOCUMENTS

| | | | |
|---|---|---|---|
| 9,199,123 | B2 | 12/2015 | Solow |
| 9,339,712 | B2 | 5/2016 | De Biasi |
| 9,517,375 | B2 | 12/2016 | Lagree |
| 9,539,462 | B2 | 1/2017 | Carter |
| 10,046,193 | B1 | 8/2018 | Aronson |
| 10,279,207 | B2 | 5/2019 | Lagree |
| 10,946,230 | B2 | 3/2021 | Lagree |
| 11,413,488 | B2 | 8/2022 | Lagree |
| 2001/0056011 | A1 | 12/2001 | Endelman |
| 2002/0022551 | A1 | 2/2002 | Watterson |
| 2003/0078138 | A1 | 4/2003 | Toyama |
| 2003/0119635 | A1 | 6/2003 | Arbuckle |
| 2004/0077464 | A1 | 4/2004 | Feldman |
| 2004/0142800 | A1 | 7/2004 | Gerschefske |
| 2004/0248710 | A1 | 12/2004 | Rodgers, Jr. |
| 2005/0130810 | A1 | 6/2005 | Sands |
| 2005/0164856 | A1 | 7/2005 | Parmater |
| 2006/0046914 | A1 | 3/2006 | Endelman |
| 2006/0172862 | A1 | 8/2006 | Badarneh |
| 2006/0199712 | A1 | 9/2006 | Barnard |
| 2006/0211543 | A1 | 9/2006 | Feldman |
| 2006/0293156 | A1 | 12/2006 | Trees |
| 2007/0087921 | A1 | 4/2007 | Graham |
| 2008/0070765 | A1 | 3/2008 | Brown |
| 2008/0242511 | A1 | 10/2008 | Munoz |
| 2008/0248935 | A1 | 10/2008 | Solow |
| 2009/0023556 | A1 | 1/2009 | Daly |
| 2009/0156372 | A1 | 6/2009 | Solomon |
| 2009/0192026 | A1 | 7/2009 | Mason |
| 2009/0203505 | A1 | 8/2009 | Kroll |
| 2009/0209393 | A1 | 8/2009 | Crater |
| 2010/0056289 | A1 | 3/2010 | Zhou |
| 2010/0227748 | A1 | 9/2010 | Campanaro |
| 2011/0009249 | A1 | 1/2011 | Campanaro |
| 2011/0039669 | A1 | 2/2011 | Stewart |
| 2011/0082016 | A1 | 4/2011 | Kim |
| 2011/0143898 | A1 | 6/2011 | Trees |
| 2011/0152032 | A1 | 6/2011 | Barnett |
| 2011/0166002 | A1 | 7/2011 | Savsek |
| 2011/0172069 | A1 | 7/2011 | Gerschefske |
| 2011/0294630 | A1 | 12/2011 | Reyes |
| 2012/0071301 | A1 | 3/2012 | Kaylor |
| 2012/0088634 | A1 | 4/2012 | Heidecke |
| 2012/0122637 | A1 | 5/2012 | Bathey |
| 2012/0238418 | A1 | 9/2012 | Reyes |
| 2012/0295771 | A1 | 11/2012 | Lagree |
| 2013/0008452 | A1 | 1/2013 | Evangelos |
| 2013/0017935 | A1 | 1/2013 | Endelman |
| 2013/0150219 | A1 | 6/2013 | Chang |
| 2013/0196835 | A1 | 8/2013 | Solow |
| 2014/0011645 | A1 | 1/2014 | Johnson |
| 2014/0100089 | A1 | 4/2014 | Kermath |
| 2014/0121076 | A1 | 5/2014 | Lagree |
| 2014/0121078 | A1 | 5/2014 | Lagree |
| 2014/0121079 | A1 | 5/2014 | Lagree |
| 2014/0141948 | A1 | 5/2014 | Aronson |
| 2015/0011362 | A1 | 1/2015 | Oh |
| 2015/0024914 | A1 | 1/2015 | Lagree |
| 2015/0027360 | A1 | 1/2015 | Schaub |
| 2015/0057127 | A1 | 2/2015 | Lagree |
| 2015/0065318 | A1 | 3/2015 | Lagree |
| 2015/0072841 | A1 | 3/2015 | Lagree |
| 2015/0141204 | A1 | 5/2015 | Lagree |
| 2015/0217164 | A1 | 8/2015 | Lagree |
| 2015/0220523 | A1 | 8/2015 | Lagree |
| 2015/0246263 | A1 | 9/2015 | Campanaro |
| 2015/0297944 | A1 | 10/2015 | Lagree |
| 2015/0343250 | A1 | 12/2015 | Lagree |
| 2015/0360068 | A1 | 12/2015 | Lagree |
| 2015/0360083 | A1 | 12/2015 | Lagree |
| 2015/0360113 | A1 | 12/2015 | Lagree |
| 2015/0364058 | A1 | 12/2015 | Lagree |
| 2015/0367166 | A1 | 12/2015 | Lagree |
| 2016/0001118 | A1 | 1/2016 | Kuehne |
| 2016/0008657 | A1 | 1/2016 | Lagree |
| 2016/0166870 | A1 | 6/2016 | Lagree |
| 2017/0087397 | A1* | 3/2017 | Lagree ..... A63B 22/0046 |
| 2019/0255375 | A1* | 8/2019 | Lagree ..... A63B 21/4035 |
| 2020/0222741 | A1 | 7/2020 | Aronson |
| 2021/0197007 | A1* | 7/2021 | Lagree ..... A63B 21/023 |
| 2022/0379159 | A1* | 12/2022 | Lagree ..... A63B 21/0085 |

FOREIGN PATENT DOCUMENTS

| | | | |
|---|---|---|---|
| WO | 2004096376 | A1 | 11/2004 |
| WO | 2008010797 | A1 | 1/2008 |

OTHER PUBLICATIONS

PCT International Search Report for PCT/US2017/028393; Jul. 11, 2017.

PCT Preliminary Report on Patentability and Opinion for PCT/US2015/033463; Dec. 15, 2016.

http://www.walmart.com/ip/total-gym-1400/23816097?adid=15000000000000027727770;Webpage from www.Walmart.com for the Total Gym 1400; Received and Printed Aug. 25, 2014.

www.SolidMasters.com, Picture from SolidMasters Website Page via Archive.org; Jul. 7, 2014.

www.SolidMasters.com; SolidMasters Website Page via Archive.org; Jul. 7, 2014.

EPO Search Report for European Application No. EP15807353.6; Feb. 9, 2018.

https://www.youtube.com/watch?V=FroSxJ3T6jE; Screen Capture at 1:52 in the YouTube Video Titled "Megaformer Evolution Promo"; Published on Sep. 1, 2014.

PCT Preliminary Report on Patentability and Opinion for PCT/US2017/028393; Nov. 1, 2018.

* cited by examiner

EXERCISE MACHINE SUPPORT SYSTEM

CROSS REFERENCE TO RELATED APPLICATIONS

The present application is a continuation of U.S. application Ser. No. 17/884,050 filed on Aug. 9, 2022, which is a continuation of U.S. Application Ser. No. 17/198,435 filed on Mar. 11, 2021 now issued as U.S. Pat. No. 11,413,488, which is a continuation of U.S. application Ser. No. 16/403,608 filed on May 5, 2019 now issued as U.S. Pat. No. 10,946,230, which is a continuation of U.S. application Ser. No. 15/376,600 filed on Dec. 12, 2016 now issued as U.S. Pat. No. 10,279,207, which is a continuation of U.S. application Ser. No. 14/742,106 filed on Jun. 17, 2015 now issued as U.S. Pat. No. 9,517,375, which claims priority to U.S. Provisional Application No. 62/013,028 filed Jun. 17, 2014 and U.S. Provisional Application No. 62/090,077 filed Dec. 10, 2014. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND OF THE INVENTION

Field of the Invention

The present invention relates generally to supports for an exercise machine and more specifically it relates to an exercise machine support system for providing increased versatility including inclination or declination of an exercise surface, a reduction in the overall length and width of the exercise machine, and an enhanced user interface which reduces the risk of injury.

Description of the Related Art

Any discussion of the related art throughout the specification should in no way be considered as an admission that such related art is widely known or forms part of common general knowledge in the field.

Contemporary exercise machines such as Pilates apparatuses are well known throughout the fitness industry, and have remained true to Joseph Pilates's century-old design, that is the apparatuses are generally comprised of a rectangular frame supported by legs at the four corners. Apparatuses with an especially large length to width ratio may require additional support legs along the length. Some apparatuses have a perimeter frame rather than legs, with the entire lower surface of the frame in contact with the floor. In both overall design and function, Pilates apparatuses have remained of similar design to the original Pilates hospital beds with springs.

More specifically, Pilates apparatuses are well known to be comprised of a rectangular, horizontal base structure with parallel rails aligned with the major length axis of the rectangular structure, and a slidable carriage thereupon that is attached to one end of the structure by springs or elastic bands that produce a resistance bias. The resistance springs are located between and parallel to the parallel rails.

Moving the slidable carriage along the rails in a direction opposite the end of the apparatus to which the spring resistance is attached creates a workload against which therapeutic or fitness exercises can be safely and beneficially performed.

One major deficiency related to the design of currently available apparatuses is that the rails, slidable carriage and bias members are located within the generally rectangular perimeter structure, requiring exercisers to step over the perimeter structure in order to mount the apparatus. Logically, the exerciser must also step over the perimeter structure and on to the floor below when dismounting the apparatus following exercise. Stepping over a perimeter structure to mount or dismount the apparatus is unnatural and awkward, and increases the chances that an exerciser will trip, fall, and become injured during mounting or dismounting the apparatus.

Another major deficiency of currently available exercise machines is that the overall length and width of the perimeter structure must be sufficiently large enough to accommodate the installation of the parallel rails, spring biasing means and slidable carriage within the major dimensions of the perimeter structure. The resulting Pilates apparatus and structure therefore becomes physically large and cumbersome. When a large number of apparatuses are installed in a Pilates studio of a fixed floor size, a smaller number of large Pilates apparatuses can be installed compared to smaller sized apparatuses. Therefore, reducing the total number of Pilates apparatuses that can be installed within a studio of a given size directly correlates to reduced revenue opportunity when compared to installing more apparatuses of a smaller overall dimension.

Another major deficiency of currently available Pilates apparatuses is that the slidable carriage and rails upon which it sides is traditionally fixed in the horizontal position. Raising or lowering one end of the apparatus has the beneficial effect of increasing or decreasing the intensity of an exercise routine by adding or subtracting a portion of the exerciser's body weight to the spring resistance. Traditional Pilates apparatuses are unable to tilt along the longitudinal axis, and are therefore unable to use the exerciser's body weight to increase or decrease exercise intensity.

Still another deficiency of Pilates apparatuses is that the bias members are located within the inner dimension of the parallel sliding rails, necessitating that the rails must be of sufficient distance to accommodate a plurality of resistance springs, thereby significantly increasing the overall width of the apparatus. It is nearly impossible for the average sized person to comfortably straddle a Pilates apparatus. Mounting a Pilates apparatus from the side, rather than from one end, is more difficult and increases the risk of injury.

It must be noted that although very few Pilates apparatuses provide for inclination of one end of the apparatus, there have been no apparatuses discovered that provide for declining one end of the apparatus, nor have apparatuses been discovered that provide for inclining and declining the major longitudinal axis relative to the horizontal plane. Those skilled in the art will immediately appreciate the need for an improved exercise machine with smaller perimeter dimensions, yet retaining substantially the length and width of the rails, slidable carriage and bias members, thereby allowing for the installation of an increased number of exercise machines within a fixed studio floor area.

It will also be appreciated that a new and novel exercise machine that eliminates or substantially reduces the need for exercisers to continually step over the perimeter structure while mounting and dismounting the exercise machine will lead to fewer injuries, and correspondingly the studio's reduced economic or legal liability exposure.

It will be further appreciated by those skilled in the art that an exercise machine that provides for inclining and declining the exercise machine relative to the traditional horizontal plane will also provide for an increased number of beneficial exercises that can be performed on the exercise machine that cannot be performed on the prior art.

Because of the inherent problems with the related art, there is a need for a new and improved exercise machine support system for providing increased versatility including inclination or declination of an exercise surface, a reduction in the overall length and width of the exercise machine, and an enhanced user interface which reduces the risk of injury.

BRIEF SUMMARY OF THE INVENTION

The invention generally relates to a support system for an exercise machine which includes a cantilevered exercise machine which is adapted to have a variable angle of incline or decline with respect to a horizontal ground surface. The exercise machine will generally include a base and a support which extends between the base and the exercise machine. The upper end of the support is connected to the exercise machine by a first pivot such that the exercise machine pivots about the support. An adjustment device may be utilized to pivot the exercise machine and thus adjust its angle of incline. Various types of adjustment devices are disclosed, including an actuator, ratchet-and-pawl, gears, and cam.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
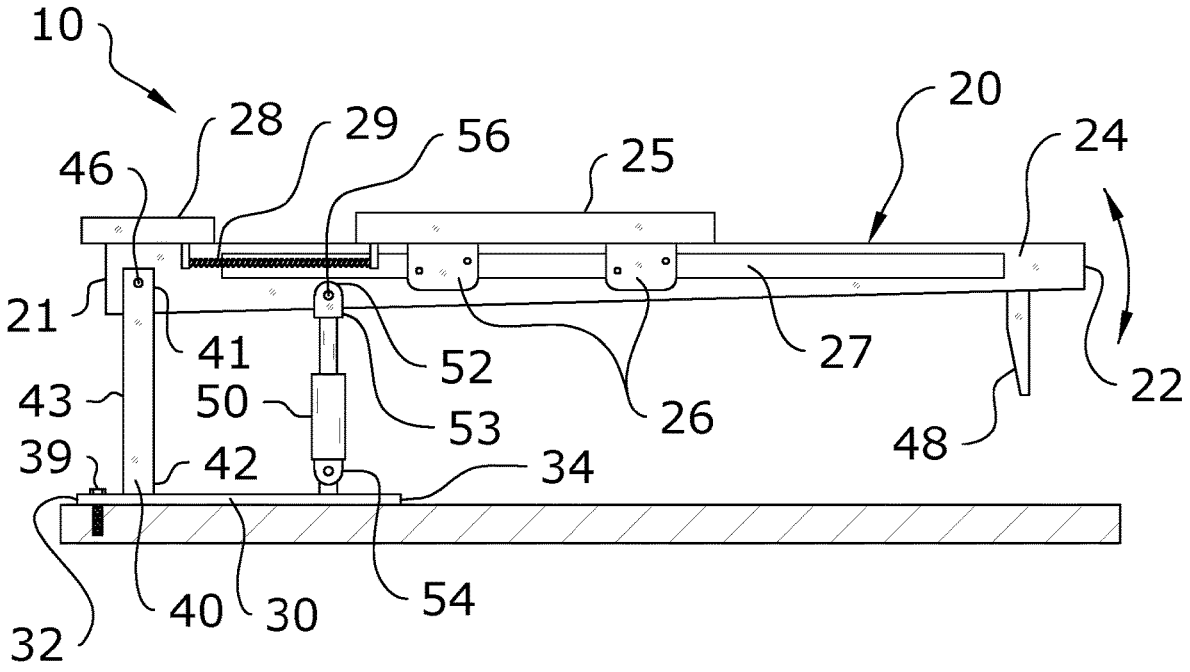
FIG. 1 is a side view of an actuator-based embodiment of the present invention in a horizontal orientation.

Turning now descriptively to the drawings, in which similar reference characters denote similar elements throughout the several views, FIGS. 1 through 25 illustrate a exercise machine support system 10, which comprises a cantilevered exercise machine 20 which is adapted to have a variable angle of incline or decline with respect to a horizontal ground surface. The exercise machine 20 will generally include a base 20 and a support 40 which extends between the base 20 and the exercise machine 20. The upper end 42 of the support 40 is connected to the exercise machine 20 by a first pivot 46 such that the exercise machine 20 pivots about the support 40. An adjustment device 50 may be utilized to pivot the exercise machine 20 and thus adjust its angle of incline. Various types of adjustment devices 50 are disclosed, including an actuator, ratchet-and-pawl, gears 70, 72, and cam 74.

The present invention is a new and novel exercise machine 20 that reduces the overall perimeter dimension, minimizes the width dimension cantilevering a second end 22 of the exercise machine 20 that is typically supported by a lower support structure, and moves the carriage bias members 29 typically located between the rails 24 to outside of the rails 24.

More specifically, the present invention teaches one or more rails 24, with the one or more rails 24 supported at only a first end 21 of the exercise machine 20 and the second end 22 being free-standing and supported by the first end 21 in a cantilevered configuration. By eliminating the perimeter structure that would otherwise be required around the perimeter of the rails 24, the present invention further provides for improved mounting and dismounting of the exercise machine 20 by an exerciser 11 without requiring the exerciser 11 to step over any perimeter structure.

Further, reduction of the perimeter dimensions provides for the possibility of installing a larger number of exercise machines 20 within the fixed floor space of any given exercise space, and at the same time, reduces the risk of exerciser injury.

Still further, the present invention provides for the inclination or declination of the exercise machine 20 relative to the horizontal plane, thereby allowing instructors or exercisers 11 to create new modifications, or introduce modifications never before available into existing exercises, benefitting from the addition or subtraction of a portion of the exerciser's 11 body weight to or from the variable spring resistance.

Further, those skilled in the art will immediately appreciate the significant commercial advantages of the present invention, including the ability to install more exercise machines 20 within a fixed space to accommodate a larger paying class of exercisers 11, and the ability of an instructor to conduct a class in a reduced amount of time without lessening the total energy output of exercisers 11 participating in the class.

Further still, those skilled in the art will understand that by relocating the carriage bias members 29 from between the parallel sliding rails 24 to the outside of the rails 24, exercisers 11 may more easily mount and dismount the exercise machine 20 with a corresponding reduction in likelihood of injuries.

One exemplary embodiment of the present invention is an exercise machine 20 comprising an assembly of one or more rails 24 preferably extending the longitudinal length of the exercise machine 20, a carriage 25 and at least one carriage bias member 29 between the carriage 25 and a first end 21 of the exercise machine 20, and the exercise machine 20 being cantilevered from a support 40.

Another exemplary embodiment of the present invention is an exercise machine 20 comprising an assembly of one or more rails 24 preferably extending the longitudinal length of the exercise machine 20, a carriage 25 and at least one carriage bias member 29 connecting the carriage 25 and a first end 21 of the exercise machine 20, and the exercise machine 20 extending from a support 40 at the first end 21, with an interstitial support 48 and cantilevered second end 22.

Another exemplary embodiment of the present invention is an exercise machine 20 comprising a cantilevered assembly of a carriage 25 that rolls along one or more rails 24 extending the substantial length of the exercise machine 20, the carriage 25 being attached to a first end 21 of the exercise machine 20 by one or more carriage bias members 29, a support 40 supporting the cantilevered exercise machine 20 substantially from its first end 21, and an adjustment device 50 to incline or decline the inclination angle of the cantilevered exercise machine 20 relative to a horizontal plane.

Another exemplary embodiment of the present invention is an exercise machine 20 comprising a cantilevered assembly of a carriage 25 that rolls along one or more rails 24 extending the substantial length of the exercise machine 20, the carriage 25 being attached to a first end 21 of the exercise machine 20 by one or more carriage bias members 29, the rails 24 being located proximal to the longitudinal centerline of the exercise machine 20, and the carriage bias member 29 being located distal to the centerline, and to the exterior edge of the rails 24.

Another exemplary embodiment of the present invention is an exercise machine 20 with the elimination of a substantial portion of a perimeter support structure, thereby reducing the overall length and width of the exercise machine 20.

Yet another exemplary embodiment of the present invention is an exercise machine 20 comprising a cantilevered assembly, the angle of which can be raised or lowered relative to the support 40 by manually actuation, or by electro-mechanical, pneumatic, hydraulic, electrical or mechanical actuation, of an adjustment device 50.

Those skilled in the art will further appreciate that in order to stabilize a load applied to the cantilevered exercise machine 20, a fulcrum and a counterbalancing load must be provided. The compression force at the fulcrum, and the tensile force of the counterbalancing load are a product of well-known cantilevered beam engineering. It is not the intention to specify specific loads of distances of the loads relative to the fulcrum, but rather to introduce functional improvements through the integration of a never before used cantilevered exercise machine support system 10 taught herein.

These and other embodiments will become known to one skilled in the art, especially after recognizing the commercial and safety advantages of an exercise machine 20 with carriage bias members 29 lateral to the rails 24, the additional exercises that can be performed on an exercise machine 20 with an inclinable and declinable carriage 25 and rails 24, the ability to install a larger number of exercise machines 20 of a smaller dimension within a fixed space, and the reduced likelihood of injury to the exerciser 11 by minimizing the need to step over a perimeter support structure. The present invention is not intended to be limited to the disclosed embodiments.

B. Exercise Machine

The figures illustrate an exemplary exercise machine 20 for use with the present invention. It should be appreciated that a variety of types of exercise machines 20 may be utilized with the present invention, and thus the scope of the present invention should not be construed as limited to the exemplary exercise machine 20 embodiments shown herein. In one embodiment, the exercise machine 20 may be comprised of the "Exercise Machine" described and shown in U.S. Pat. No. 8,641,585, issued to Sebastien Lagree on Feb. 4, 2014, which is hereby fully incorporated by reference.

Figure 14:
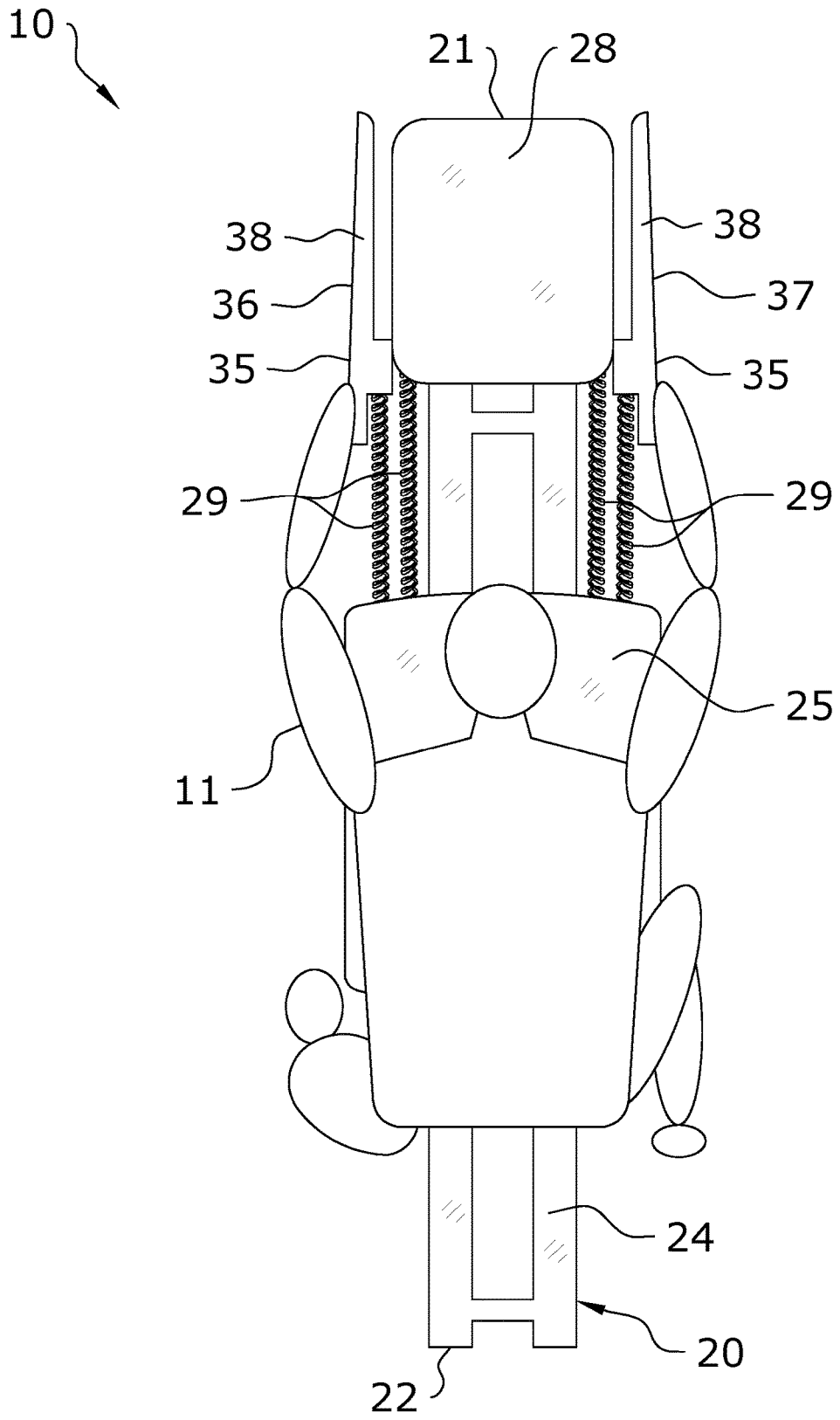
FIG. 14 is a top view of one embodiment of the present invention in use.

As best shown in FIGS. 1 and 14, an exemplary exercise machine 20 for use with the present invention comprises a first end 21 and a second end 22. The exercise machine 20 will generally be comprised of a cantilevered configuration as shown in the figures, with the second end 22 of the exercise machine 20 being unsupported.

At least one rail 24 extends between the first end 21 and the second end 22 of the exercise machine 20. A carriage 25 is generally movably secured along the at least one rail 24 so as to slide between the first and second ends 21, 22 of the exercise machine 20. Carriage brackets 26 generally extend downwardly from the carriage 25 to engage with the rail 24, such as using wheels (not shown). Any number of configurations may be utilized for movably connecting the carriage 25 to the at least one rail 24.

One or more carriage bias members 29 may be connected between the carriage 25 and the first end 21 of the exercise machine 20 as shown in FIG. 1 such that the bias members 29 exert resistance on the carriage 25 as it is moved away from the end 21, 22 of the exercise machine 20 to which the bias members 29 are secured. The bias members 29 may comprise various structure, devices, or the like which provide resistance in one direction of movement, such as resistance springs.

In some embodiments, the exercise machine 20 may include one or more platforms 28 at either end 21, 22 of the exercise machine 20. For example, FIG. 1 of the drawings shows a platform 28 positioned at the first end 21 of the exercise machine 20. While the figures do not illustrate a platform 28 on the second end 22 of the exercise machine 20, it should be appreciated that a platform 28 may be positioned at the second end 22 in addition to or in alternative to a platform 28 being positioned at the first end 21. One or more handles 38 may also extend from the first end 21, the second end 22, or both ends 21, 22 of the exercise machine 20 in some embodiments.

In the diagram, the first end 21 of the exercise machine 20 is pivotally affixed at a first pivot 46 of a stationary support 40 thereby providing for the cantilevered first end 21 of the exercise machine 20 to rotate about the first pivot 46, with the support 40 acting as a fulcrum of a lever. The exercise machine 20 is also pivotally affixed to an adjustment device 50. The adjustment device 50 can be adjusted to raise or lower the second end 22 of the cantilevered exercise machine 20.

In the figures, cords 14 with a cord handle 15 are shown threaded about a pulley 16, and further affixed to the carriage 25 of the exercise machine 20. The cords 14 may be incorporated into an exercise machine 20 as an accessory, and may be attached or removed from the exercise machine 20 as desired by the exerciser 11 or instructor. An exerciser 11 positioned upon the carriage 25 may perform an exercise by grasping the handles 15 of the cords 14 with their hands, and pulling the cords 14. The required pulling force upon the cords 14 must be sufficient enough to overcome the resistance force of the carriage bias members 29 between the carriage 25 and the first end 21 of the exercise machine 20.

It should be noted that the cords 14 are considered to be one of many accessories that may be attached or affixed to the present invention, but are not a requirement of the present invention. The cords 14 are illustrated merely by way of example of how various accessories may be affixed to a cantilevered exercise machine 20 without detracting from the novel function of the present invention.

Figure 2:
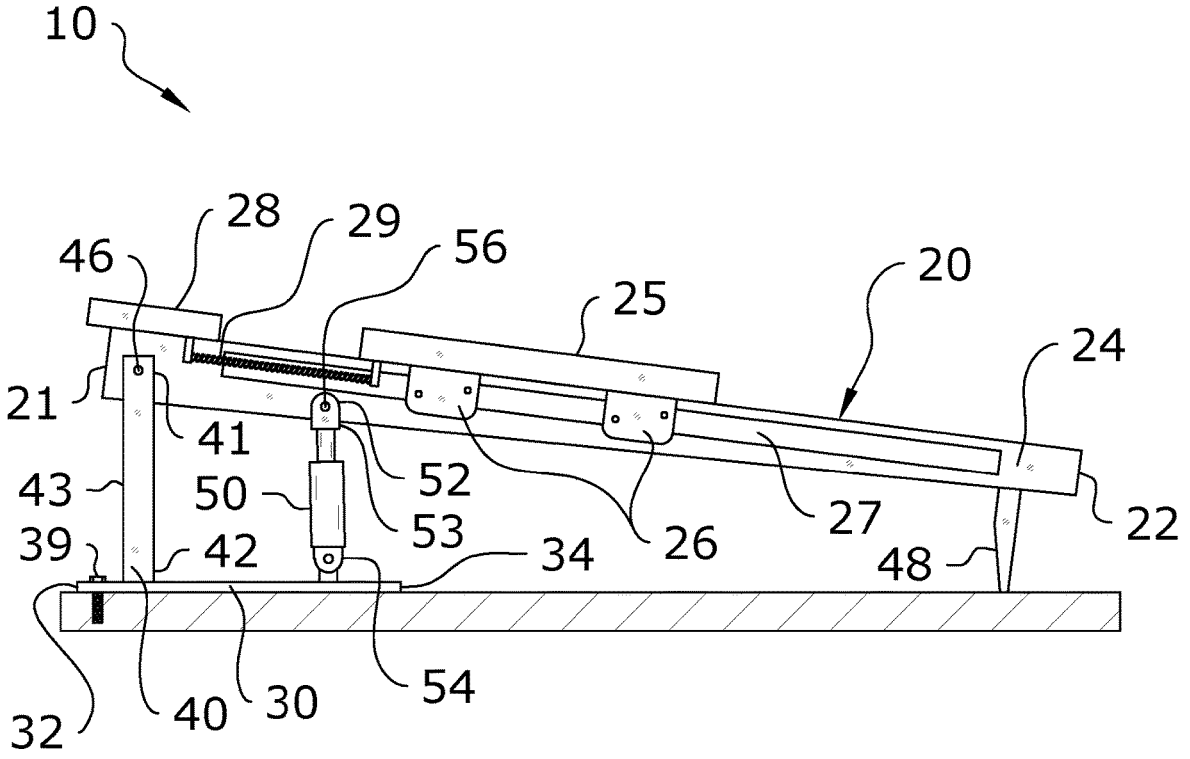
FIG. 2 is a side view of an actuator-based embodiment of the present invention in a lowered orientation.

It should be appreciated that additional supports 48 may also be utilized if necessary, such as with exceptionally heavy-duty exercise machines 20. FIGS. 1 and 2 illustrate that an additional interstitial support 48 may be positioned between the first end 21 and the second end 22 of the exercise machine 20. In some embodiments, the interstitial support 48 may not contact the ground surface when the present invention is in a horizontal configuration. In such embodiments, the interstitial support 48 will act as a "stop" to prevent the exercise machine 20 from being declined past a certain angle of declination.

C. Base

As shown in FIGS. 1-13, the present invention generally includes a base 30 which is positioned underneath the exercise machine 20. As shown in the figures, the base 30 need not extend for the entire length of the exercise machine 20, though in some embodiments the base 20 may be of an equal or greater length than the exercise machine 20. Preferably, the base 30 will be positioned underneath the first end 21 of the exercise machine 20, with the support 40 and adjustment device 50 of the present invention being connected between the base 30 and the exercise machine 20 and the base 30 being of substantially less length than the exercise machine 20 for improved stability.

The base 30 includes a first end 32 and a second end 34 as shown in FIG. 1. The base 30 will generally be secured directly to the ground surface, such as by fasteners 39 as shown in the figures. The base 30 will preferably be removably secured to the ground surface, with fasteners 39 producing sufficient force to resist the moment produced when a specified load applied downward at the second end 22 of the exercise machine 20 produces an upward force at the first end 21 of the exercise machine 20. The fasteners 39 act as an effective counterbalance to resist the maximum allowable load applied at the maximum length of the cantilevered lever arm.

In some embodiments, the base 30 may comprise the ground surface itself, with the support 40 and adjustment device 50 extending between the ground surface and the exercise machine 20. However, a discrete base 30, secured to the ground surface via one or more fasteners 39, is preferred for structural integrity of the present invention overall.

D. Outer Cover

FIGS. 11-14 illustrate an outer cover 35 which may be optionally included with the present invention. The outer cover 35 restricts access to the support 40 and adjustment device 50, thus reducing the risk of injury by inadvertently contacting any of the moving parts connected between the base 30 and the exercise machine 20.

Figure 12:
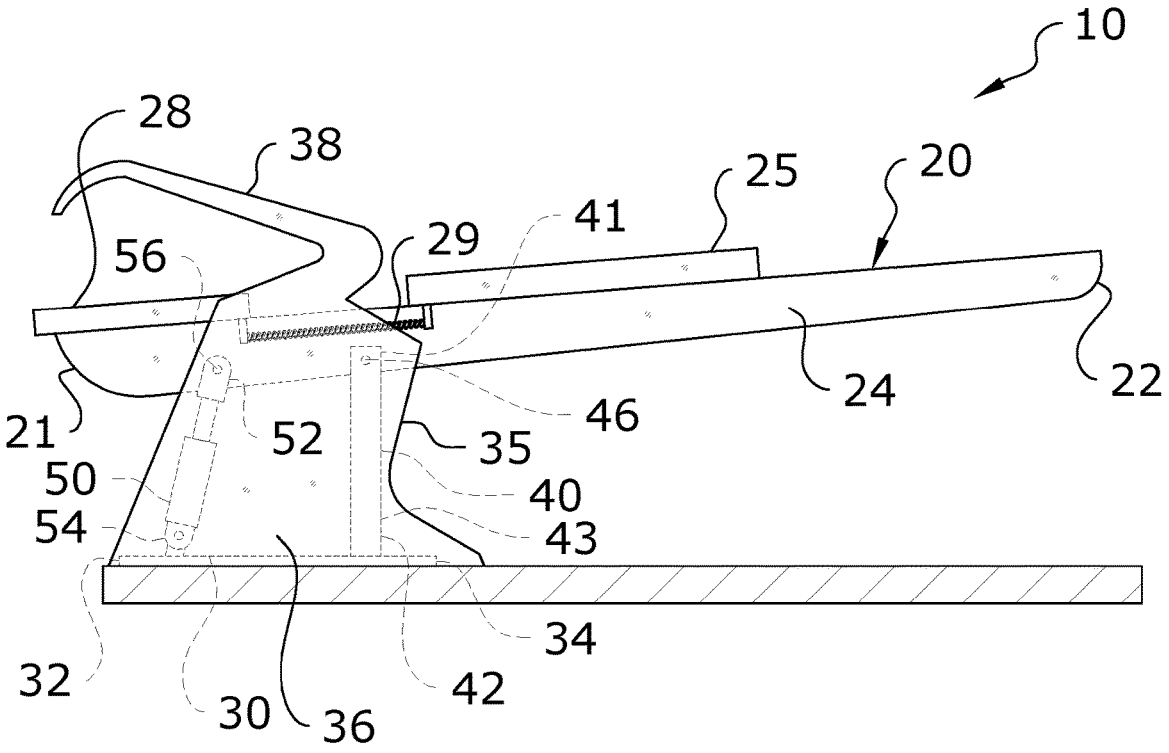
FIG. 12 is a side view of an actuator-based embodiment of the present invention with a protective outer cover in a slightly raised orientation.
Figure 13:
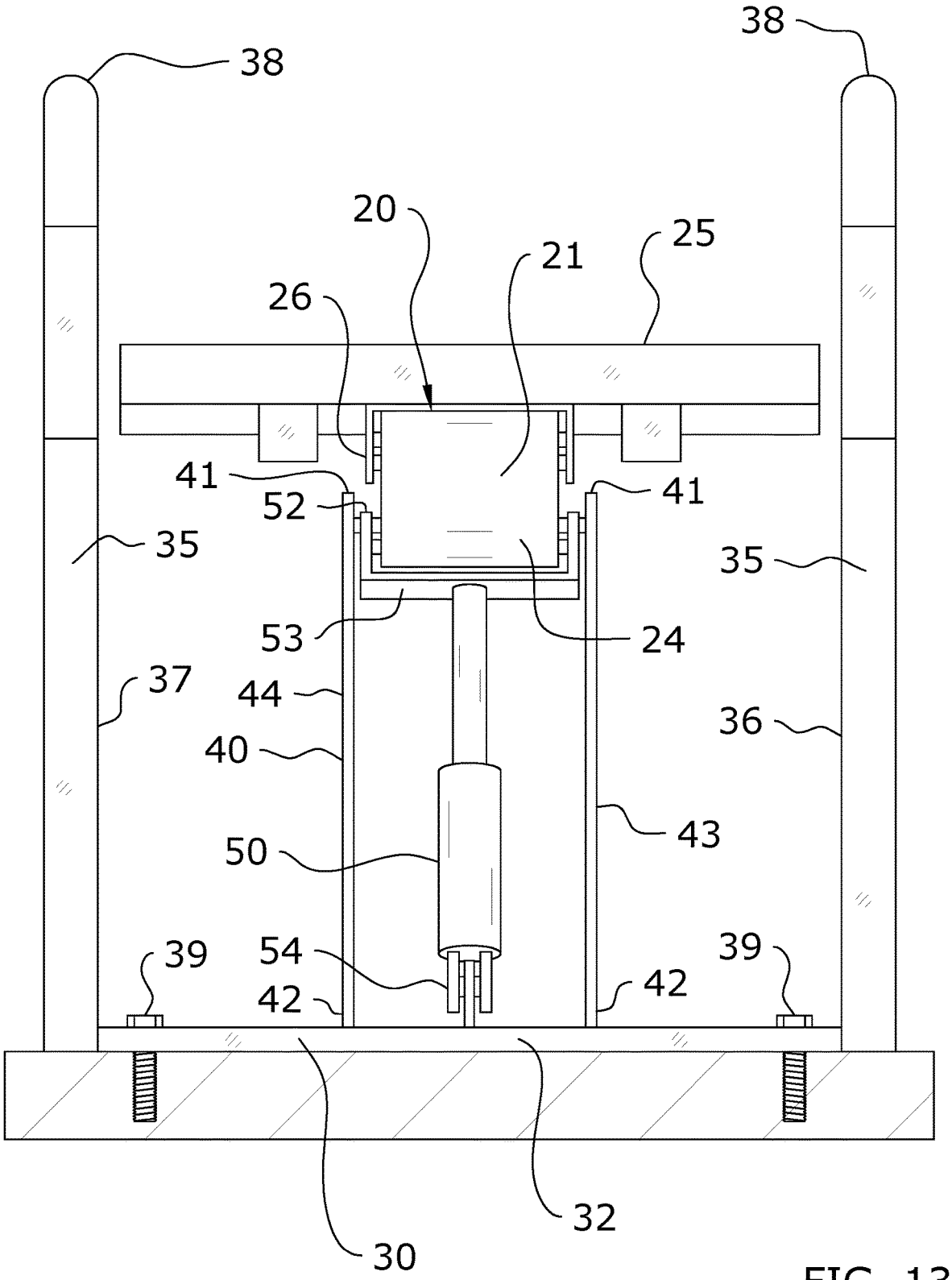
FIG. 13 is a frontal view of an actuator-based embodiment of the present invention with a protective outer cover.

As best shown in FIG. 13, the outer cover 35 generally comprises a first side 36 connected to cover the first side 43 of the support 40 and the adjustment device 50 and a second side 37 connected to cover the second side 44 of the support 40 and the adjustment device 50. The outer cover 35 may extend upwardly from the base 30 or may be installed around the base 30. One or more handles 38 may be integrated with the outer cover 35 as shown in FIG. 12, with the handles 38 being used in connection with the exercise machine 20.

E. Support

As shown throughout the figures, a support 40 is connected between the base 30 and the exercise machine 20. The support 40 acts as the fulcrum for the exercise machine 20 in its cantilevered configuration. The support 40 comprises an upper end 41 and a lower end 42. The upper end 41 of the support 40 is connected to the exercise machine 20 by a first pivot 46. The lower end 42 of the support 40 is connected to the base 30.

The support 40 may comprise various configurations and should not be construed as limited by the exemplary figures. In an embodiment shown in FIGS. 1-22, the support 40 comprises a rigid, elongated member such as a road, beam, pipe, or the like which connects between the base 30 and the exercise machine 20.

Figure 23:
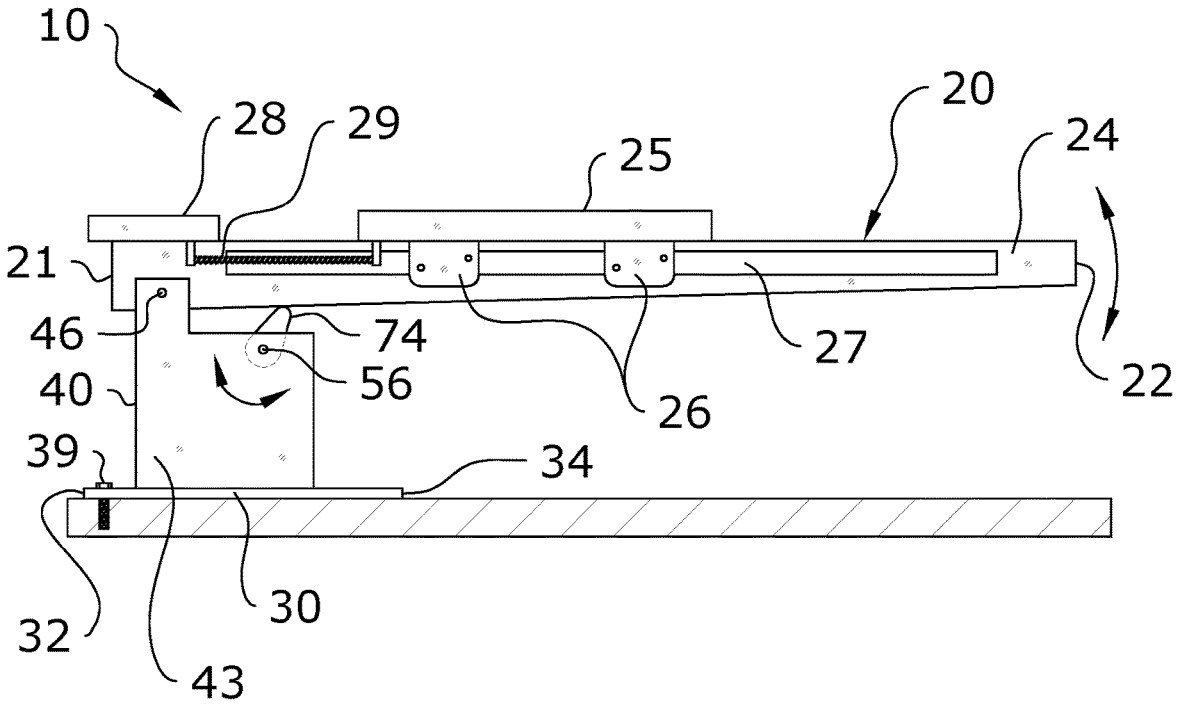
FIG. 23 is a side view of a cam-based embodiment of the present invention in a horizontal orientation.
Figure 24:
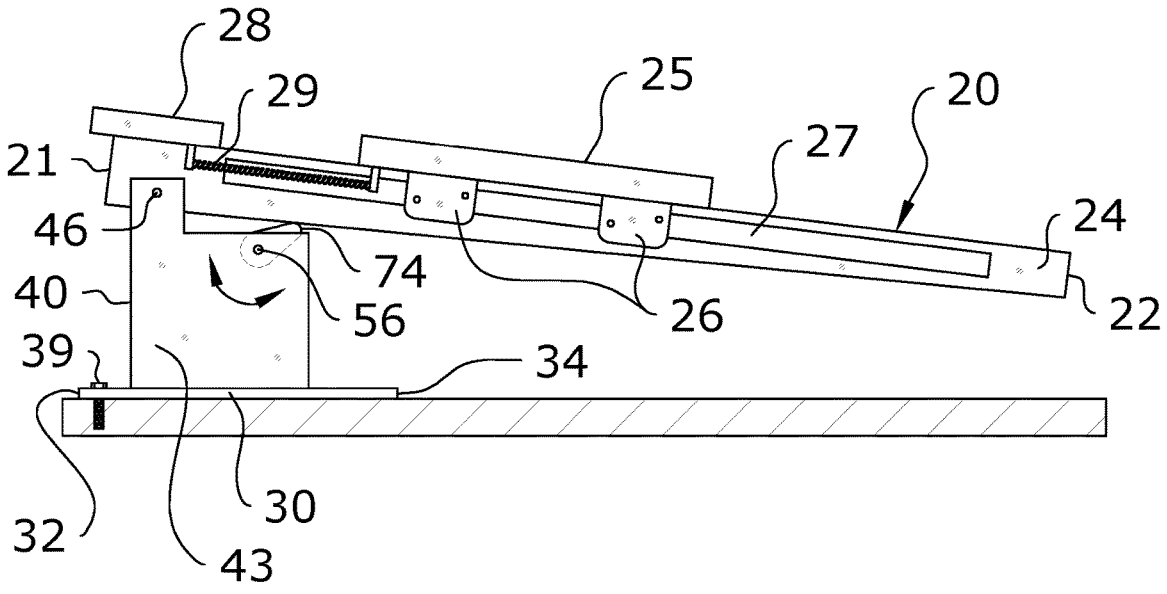
FIG. 24 is a side view of a cam-based embodiment of the present invention in a lowered orientation.
Figure 25:
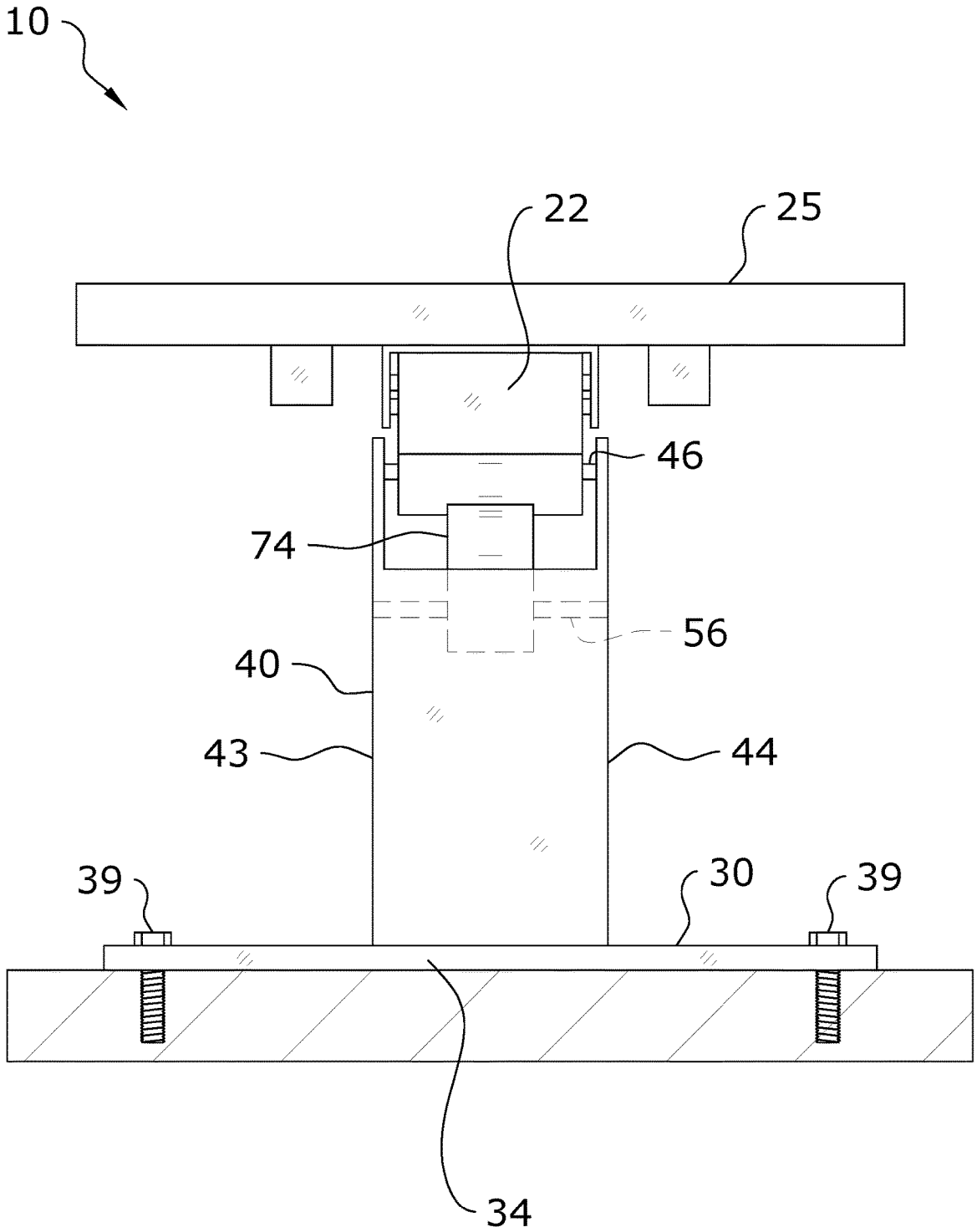
FIG. 25 is a frontal view of a cam-based embodiment of the present invention.

In an alternate embodiment shown in FIGS. 23-25, the support 40 comprises a first side 43 and a second side 44, with the first side 43 comprising a first panel and the second side 44 comprising a second panel through which the first pivot 46 is extended to pivotally connect to the exercise machine 20. As discussed herein, the first and second sides 43, 44 of the support 40 in this embodiment may include cut-out portions to accommodate a cam 74 which connects between the support 40 and the exercise machine 20.

The first pivot 46 pivotally connects the upper end 41 of the support 40 with the exercise machine 20. In the figures, the first pivot 46 is shown as being comprised of a pin at the upper end 41 of the support 40 which extends through the exercise machine 20 to create the first pivot point. Various other types of first pivots 46 may be utilized so long as the pivot point is created between the exercise machine 20 and the upper end 41 of the support 40. The exercise machine 20 pivots about the first pivot 46 at the first pivot point when the incline of the exercise machine 20 is being raised or lowered via use of the adjustment member 50.

The positioning of the support 40 may vary in different embodiments of the present invention. The support 40 may be positioned anywhere along the base 30 so long as the support 40 connects between the base 30 and the exercise machine 20. In FIGS. 1-5, the support 40 is shown as extending vertically between a position near the first end 32 of the base 30 and a positioned near the first end 21 of the exercise machine 20. In FIGS. 6-12, the support 40 extends between a point closer to the second end 32 of the base 30 and the second end 22 of the exercise machine 20. In FIGS. 15-19, the support 40 extends from a point closer to the central location on the base 30. The support 40 may be positioned on either side of the adjustment device 50 as shown in the figures.

F. Adjustment Device

As shown throughout the figures, the present invention may utilize a variety of different types of adjustment devices 50 to adjust the inclination of the exercise machine 20 by pivoting the exercise machine 20 about the first pivot 46. The following description of various embodiments should not be construed as limiting on the scope of the present invention. Any number of adjustment devices 50 may be utilized, including some configurations not described explicitly below.

i. Actuator.

FIGS. 1-13 illustrate an embodiment of the present invention in which the adjustment device 50 comprises an actuator extending between the base 30 and the exercise machine 20. Various types of actuators may be utilized with the present invention, including the piston-type shown in the figures. The type of actuator is not meant to be limiting, and may be one or more pneumatic cylinders, hydraulic cylinders, or screw jacks, so long as the actuator is capable of being manually or mechanically actuated to securely support the top exercise surface of the second end 22 of the exercise machine 20 in a horizontal plane, or when actuated, raise or lower the second end 22 of the exercise machine 20, thereby inclining or declining the top exercise surface relative to the horizontal plane.

Figure 3:
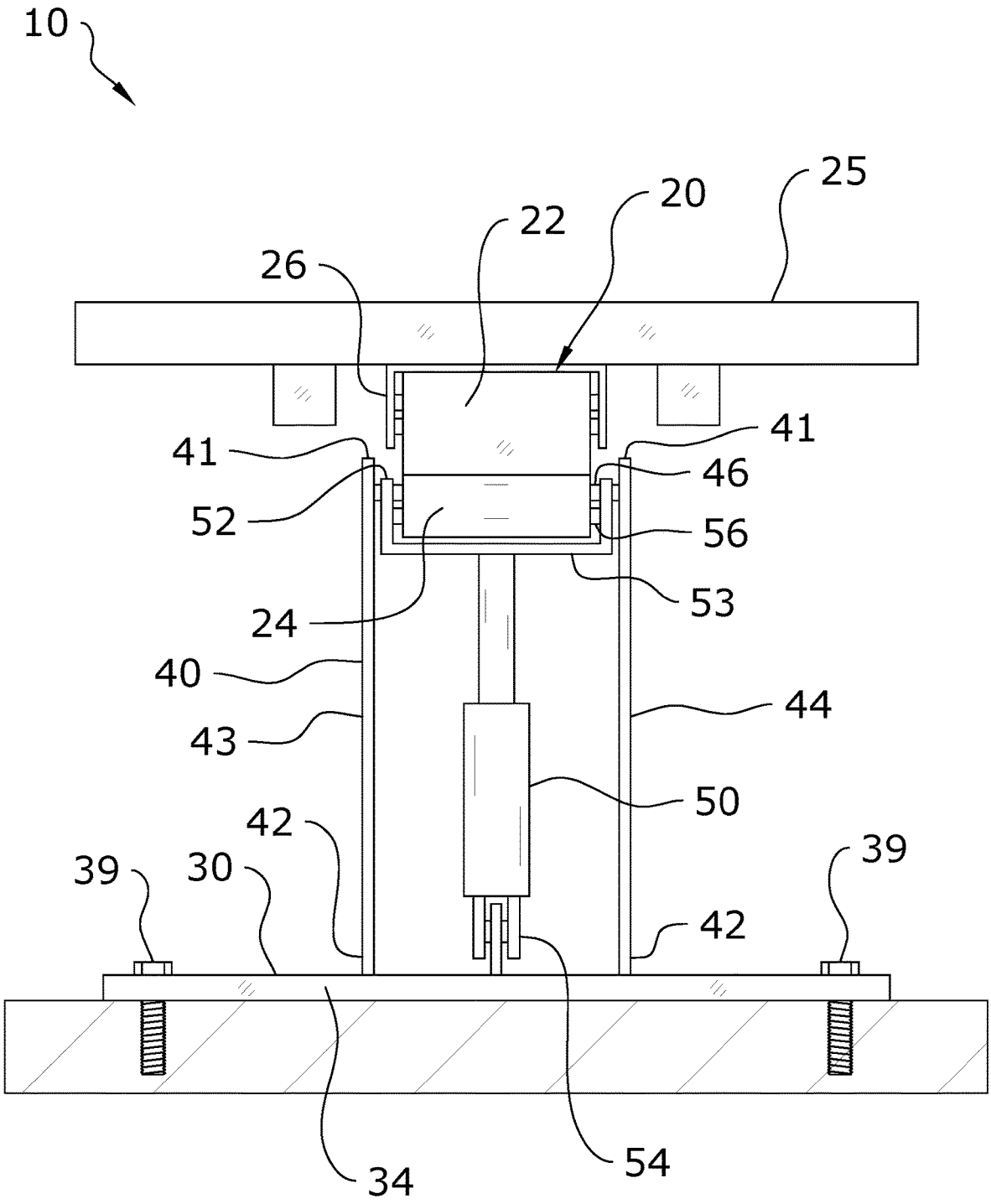
FIG. 3 is a frontal view of an actuator-based embodiment of the present invention.
Figure 4:
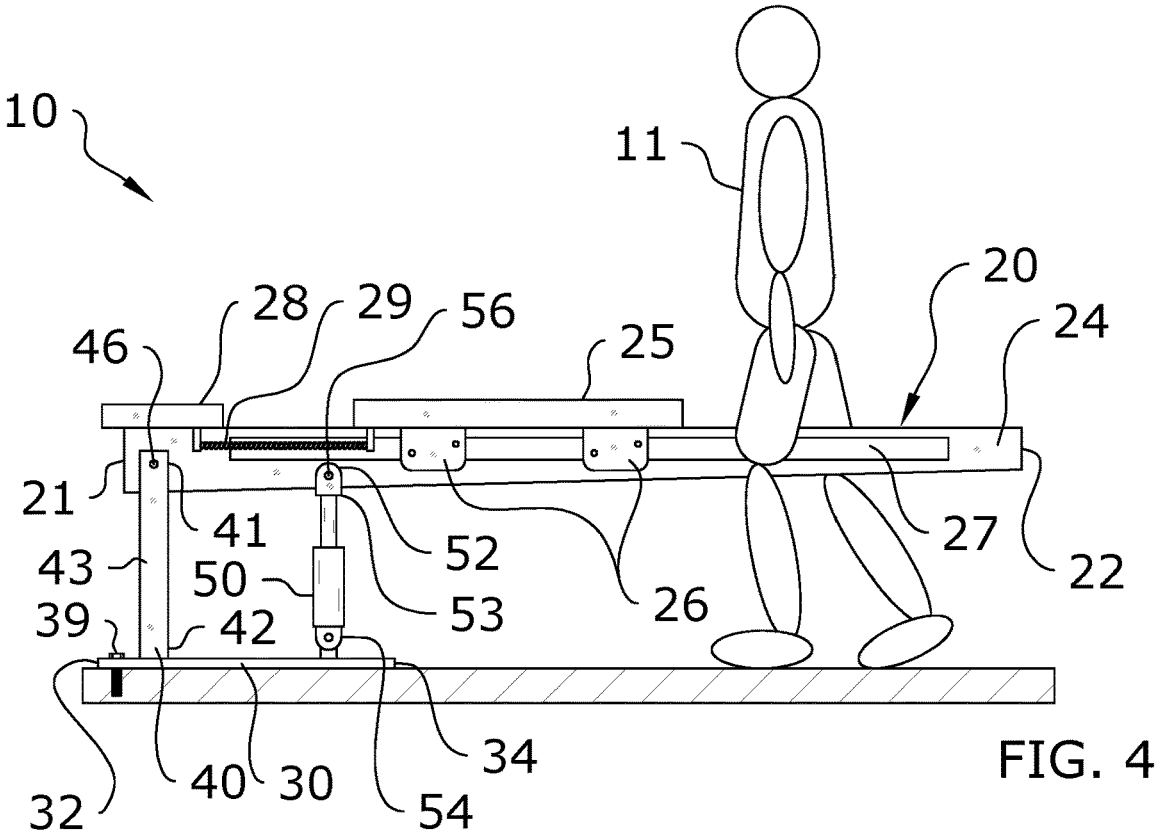
FIG. 4 is a side view of an actuator-based embodiment of the present invention in a horizontal orientation with an exerciser straddling the rail.
Figure 5:
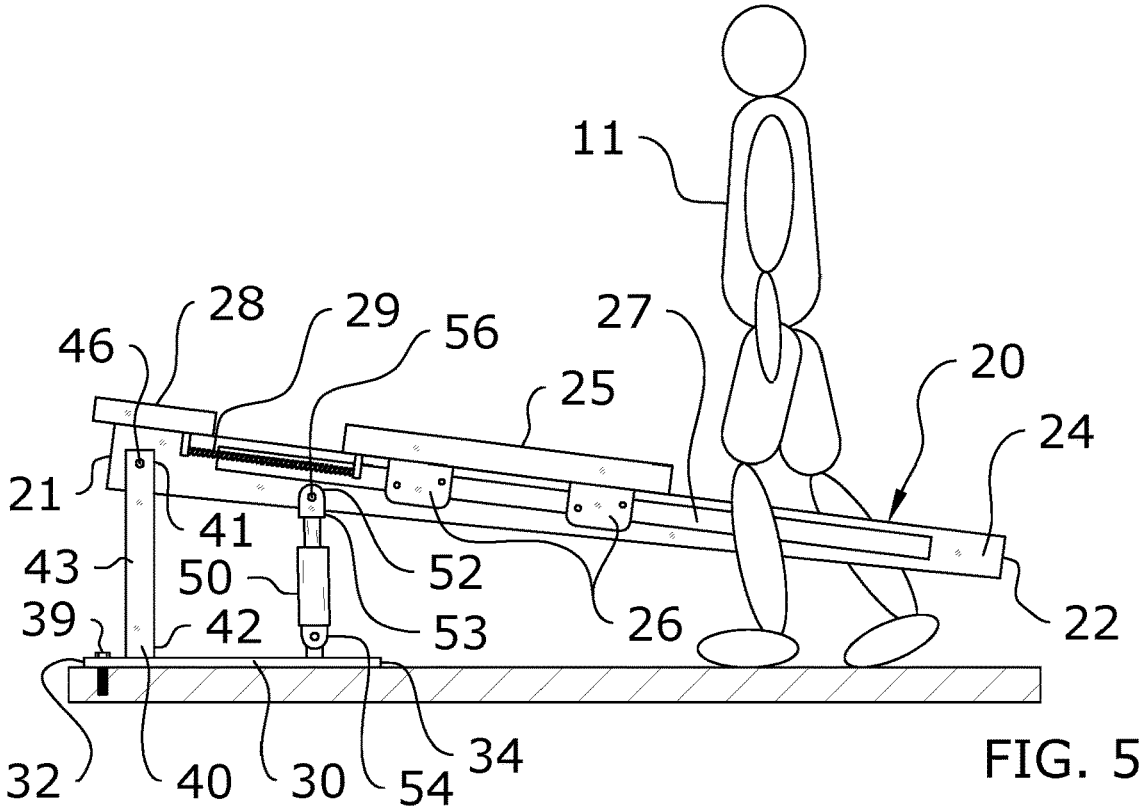
FIG. 5 is a first side view of an actuator-based embodiment of the present invention in a lowered orientation with an exerciser straddling the rail.
Figure 6:
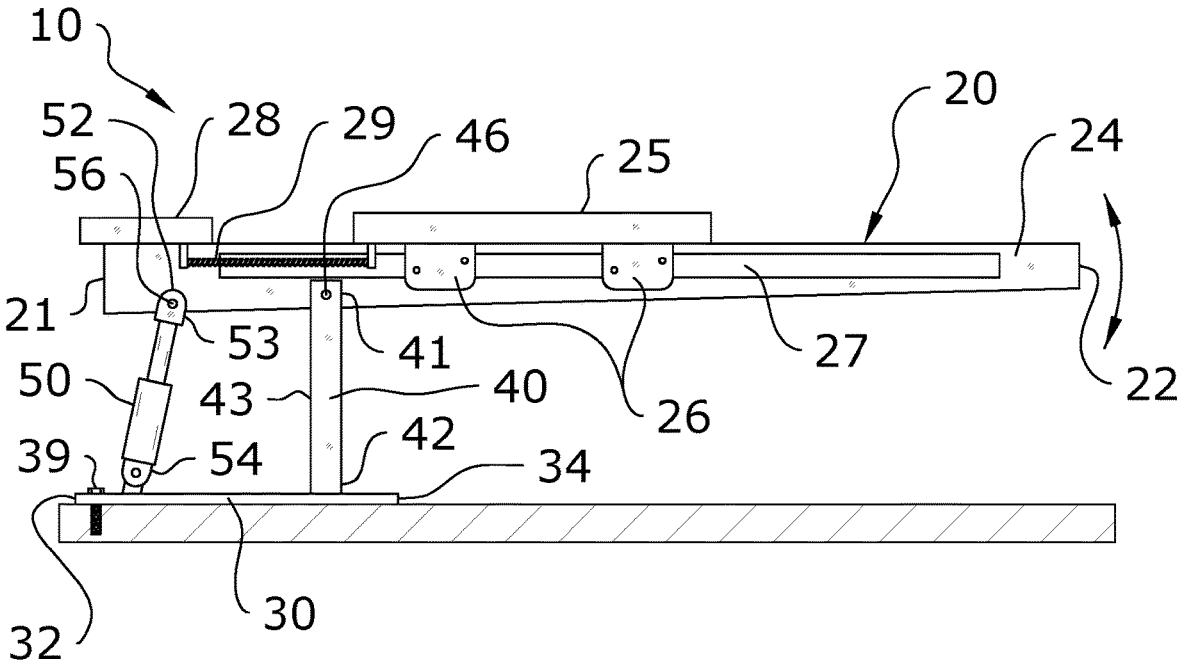
FIG. 6 is a side view of an actuator-based embodiment of the present invention in a horizontal orientation.
Figure 7:
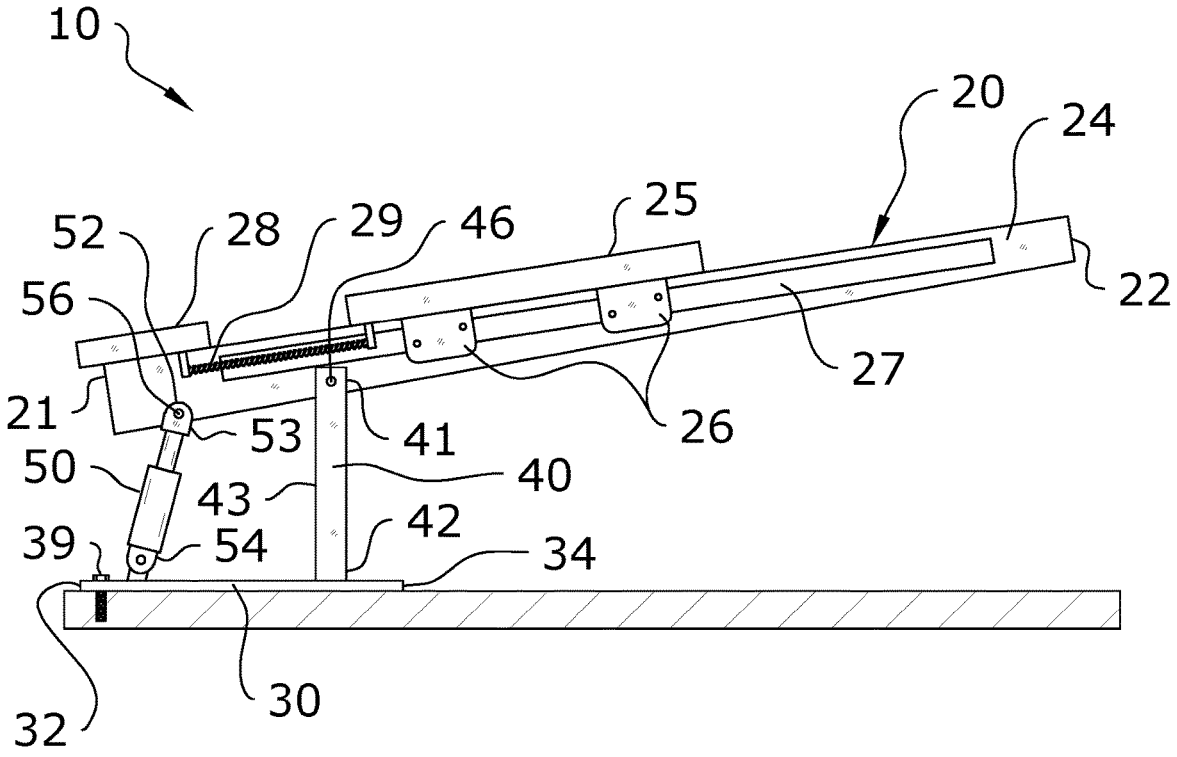
FIG. 7 is a side view of an actuator-based embodiment of the present invention in a raised orientation.
Figure 8:
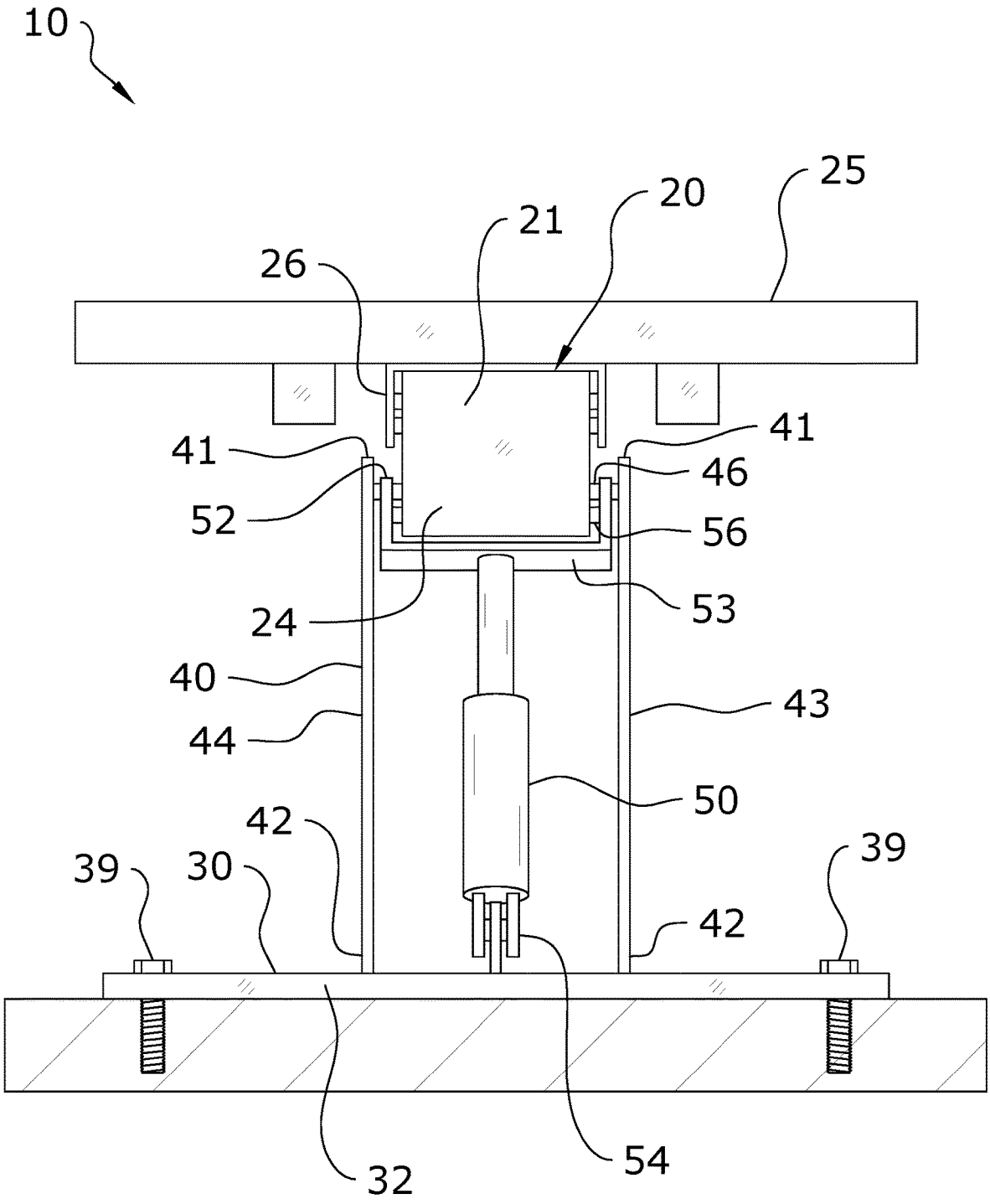
FIG. 8 is a frontal view of an actuator-based embodiment of the present invention.
Figure 9:
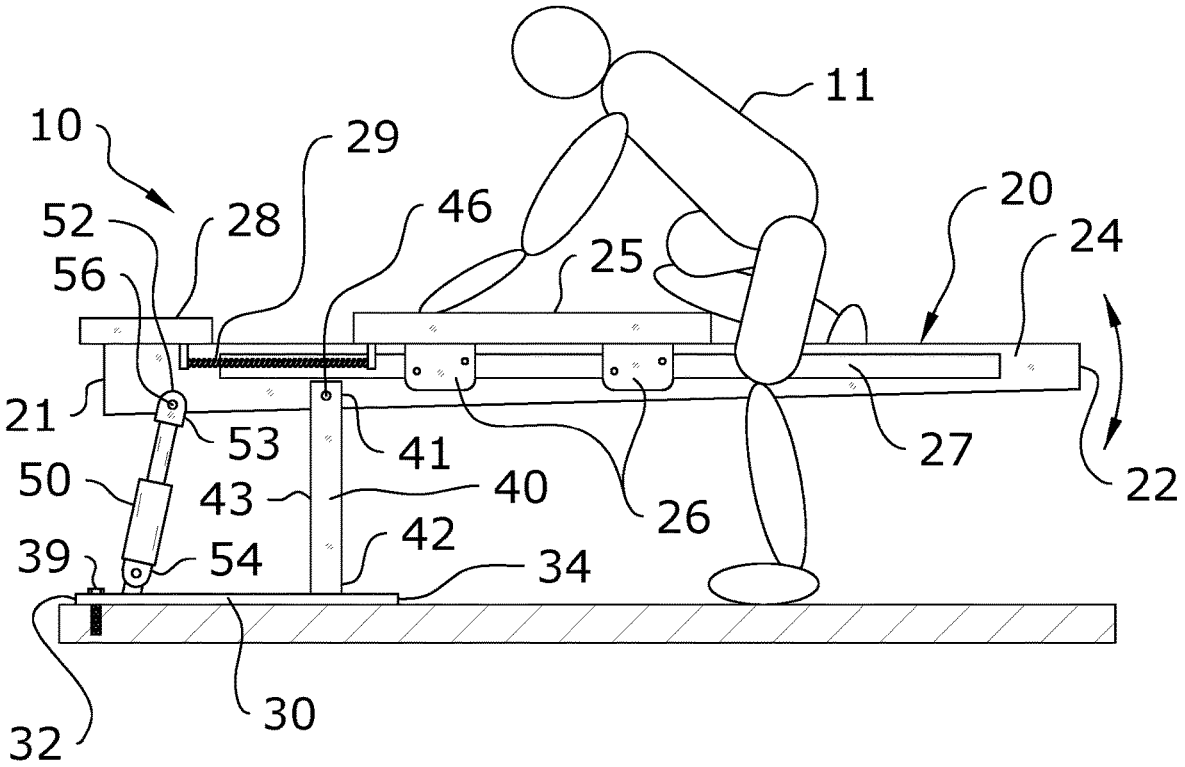
FIG. 9 is a side view of an actuator-based embodiment of the present invention in a horizontal orientation with an exerciser mounting the carriage.
Figure 10:
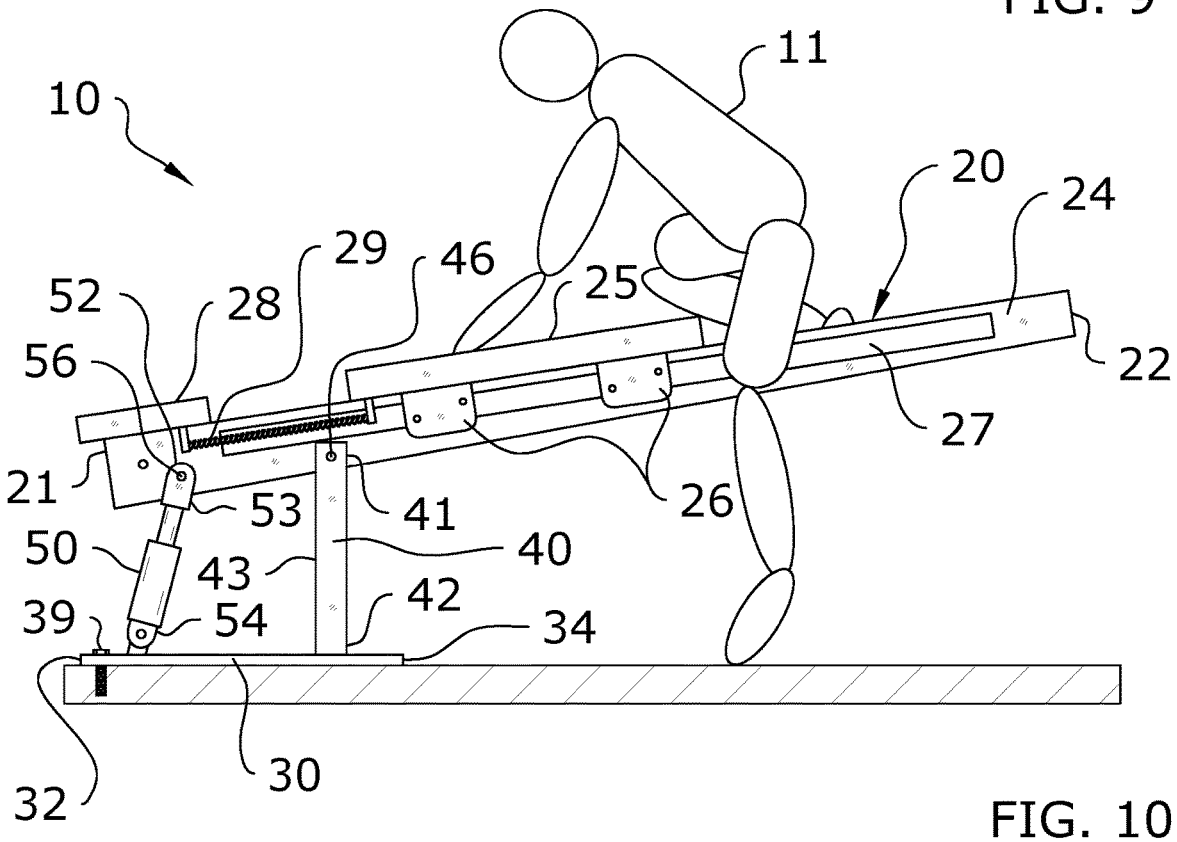
FIG. 10 is a side view of an actuator-based embodiment of the present invention in a raised orientation with an exerciser mounting the carriage.
Figure 11:
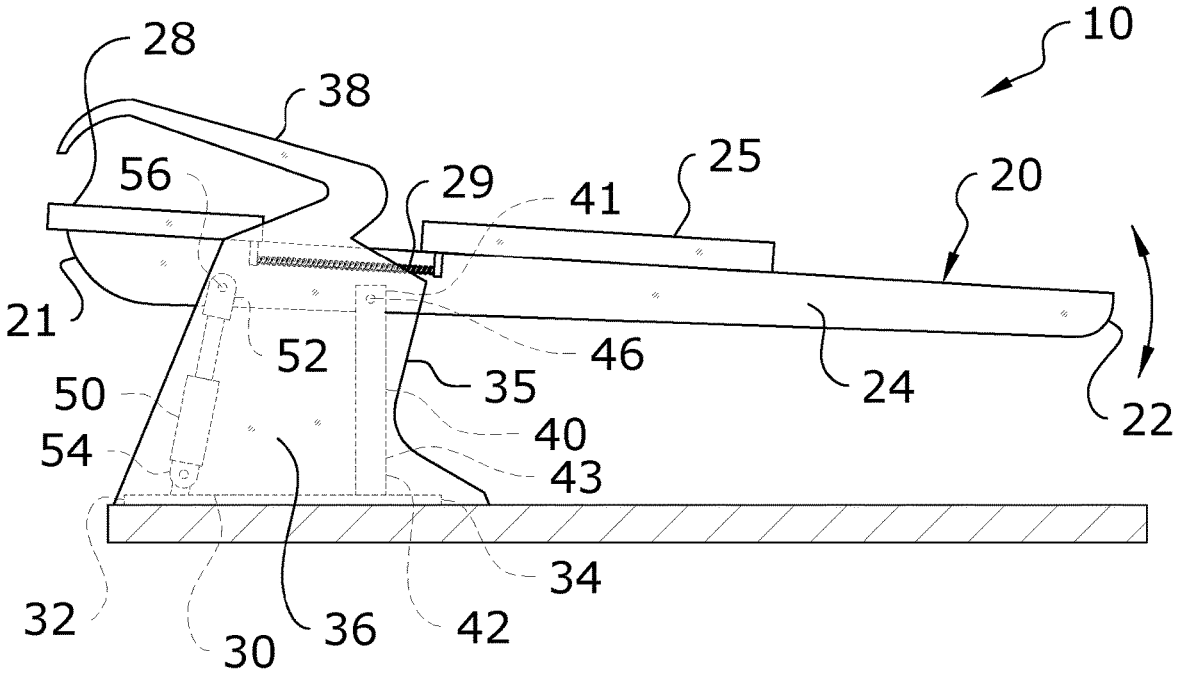
FIG. 11 is a side view of an actuator-based embodiment of the present invention with a protective outer cover in a slightly lowered orientation.

The adjustment device 50 of this embodiment includes an upper end 52 which is connected to the exercise machine 20 and a lower end 54 which is connected to the base 30. The upper end 52 may include a bracket 53 which connects around the exercise machine 20 as shown in FIGS. 3 and 13, with the bracket 53 including a second pivot 56 which extends through the exercise machine 20 to create a second pivot point.

In the figures, the second pivot 56 is shown as being comprised of a pin at the upper end 52 of the adjustment device 50 which extends through the exercise machine 20 to create the second pivot point. Various other types of second pivots 56 may be utilized so long as the second pivot point is created between the exercise machine 20 and the upper end 52 of the adjustment device 50. As the exercise machine 20 is raised or lowered by the adjustment device 50, the exercise machine 20 will slightly pivot about the second pivot 56.

The positioning of the adjustment device 50 may vary in different embodiments as shown in the figures. As shown throughout the figures, the adjustment device 50 may be positioned at any location between the first end 32 and the second end 34 of the base 30. The adjustment device 50 may be positioned on either side of the support 40 as additionally shown in the figures. FIGS. 1-5 illustrate the adjustment device 50 being positioned near the second end 34 of the base 30, between the support 40 and the second end 22 of the exercise machine 20. FIGS. 6-12 illustrate the adjustment device 50 being positioned near the first end 32 of the base 30, between the first end 21 of the exercise machine 20 and the support 40.

The orientation of the adjustment device 50 may also vary in different embodiments of the present invention. FIGS. 1-5 illustrate that the adjustment device 50 is vertically-oriented between the base 30 and the exercise machine 20. Pivoting of the second pivot 56 retains the adjustment device 50 in this vertical orientation while raising or lowering the exercise machine 20.

FIGS. 6-12 illustrate that the adjustment device 50 may alternatively be diagonally-oriented. Although the figures illustrate the adjustment device 50 being diagonally-oriented in only one direction, it should be appreciated that the adjustment device 50 could in other embodiments be diagonally-oriented in an opposite direction than that shown in the exemplary figures.

In use, the actuator-based embodiment of the present invention may be approached much like any other exercise machine 20, with the exerciser 11 positioning herself on the exercise machine 20 to perform various exercises. Exercises may be performed on the exercise machine 20 at various levels of incline, including horizontally. When it is desired to adjust the incline of the exercise machine 20, the adjustment device 50 may be activated, with the actuator either extending to raise the incline or retracting to lower the incline of the exercise machine 20. The adjustment device 50 may be activated manually or automatically by any method or device known in the art for controlling an actuator, such as by remote control (not shown).

ii. Pawl.

FIGS. 15-19 illustrate an embodiment of the present invention in which the adjustment device 50 comprises an elongated member having a plurality of adjustment notches 66 which are used in combination with a locking device 60 to adjust the level of incline of the exercise machine 20 to produce a configuration similar to a ratchet-and-pawl. The adjustment device 50 includes a plurality of adjustment notches 66 extending along its height. A separate locking device 60, such as a pawl, manually engages with the adjustment notches 66 to affix the angle of incline of the exercise machine 20.

Figure 15:
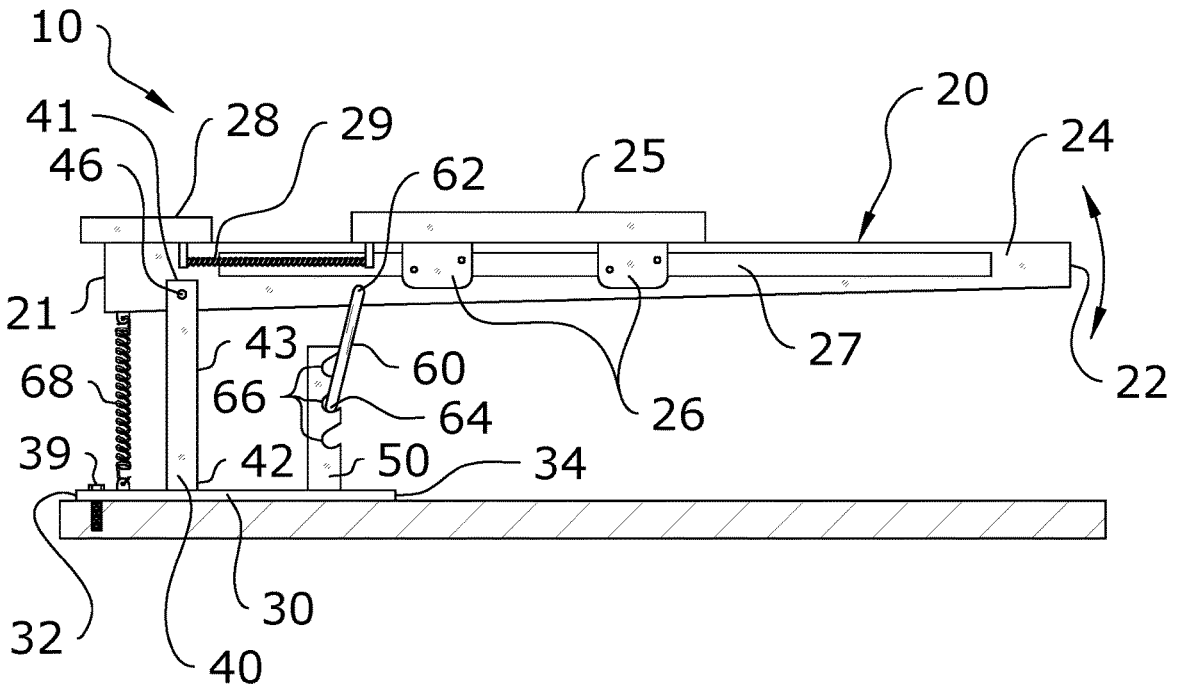
FIG. 15 is a side view of a pawl-based embodiment of the present invention in a horizontal orientation.
Figure 16:
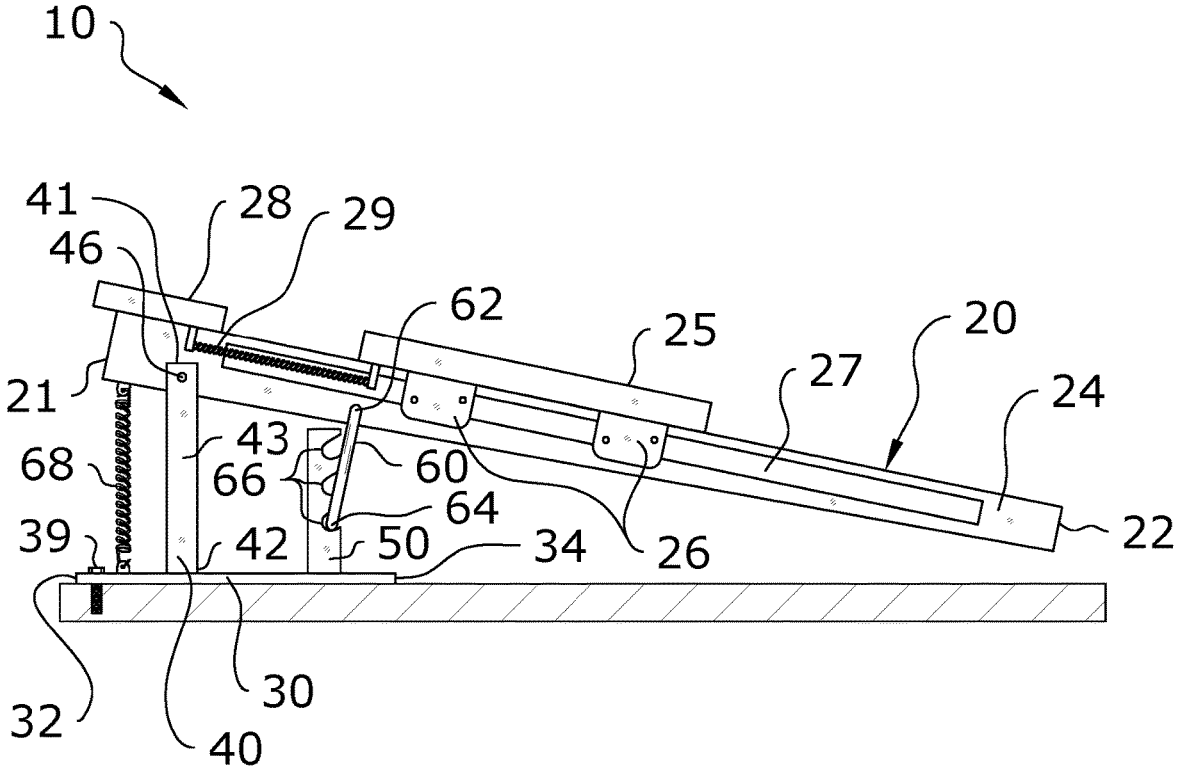
FIG. 16 is a side view of a pawl-based embodiment of the present invention in a lowered orientation.
Figure 17:
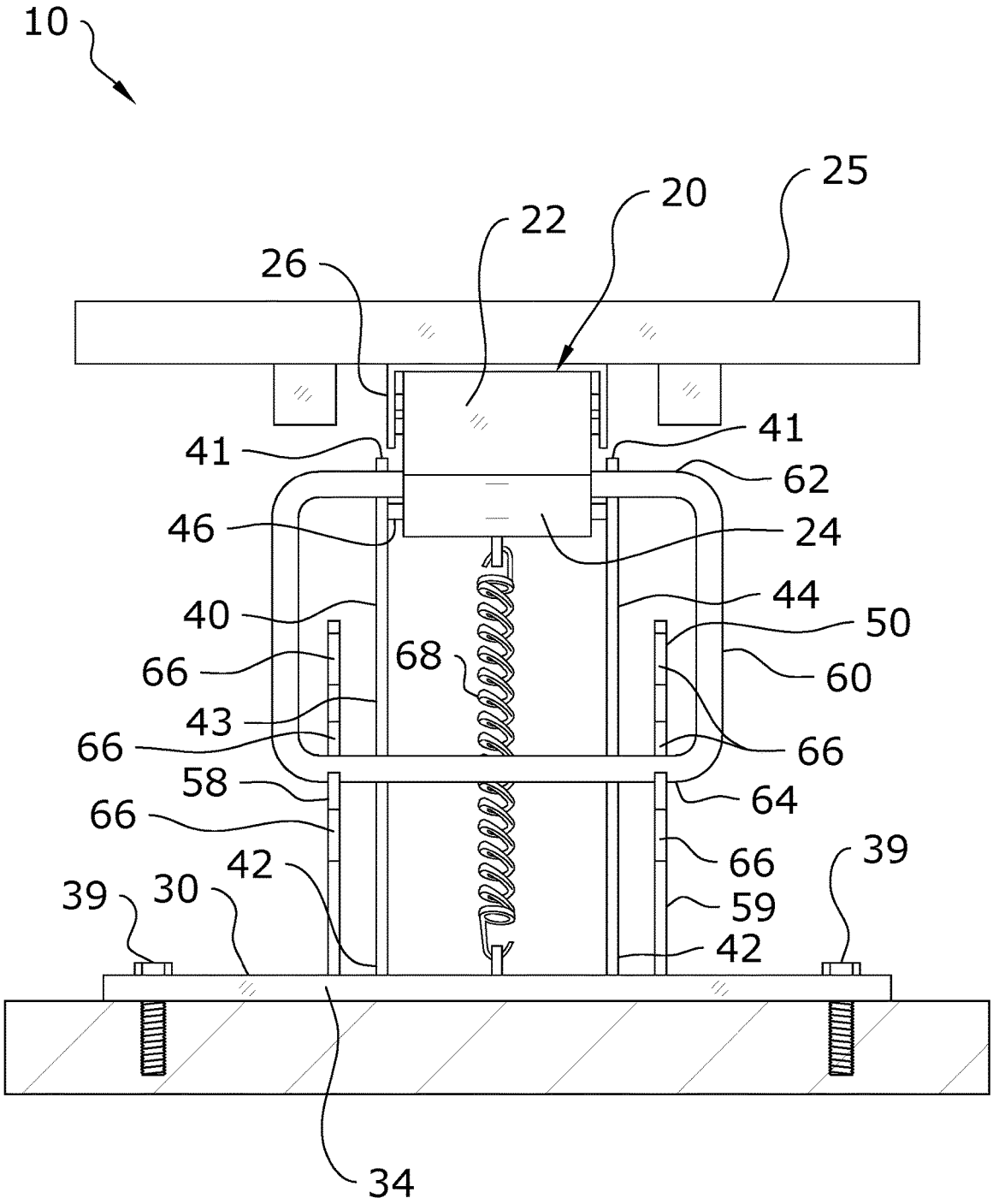
FIG. 17 is a frontal view of a pawl-based embodiment of the present invention.
Figure 18:
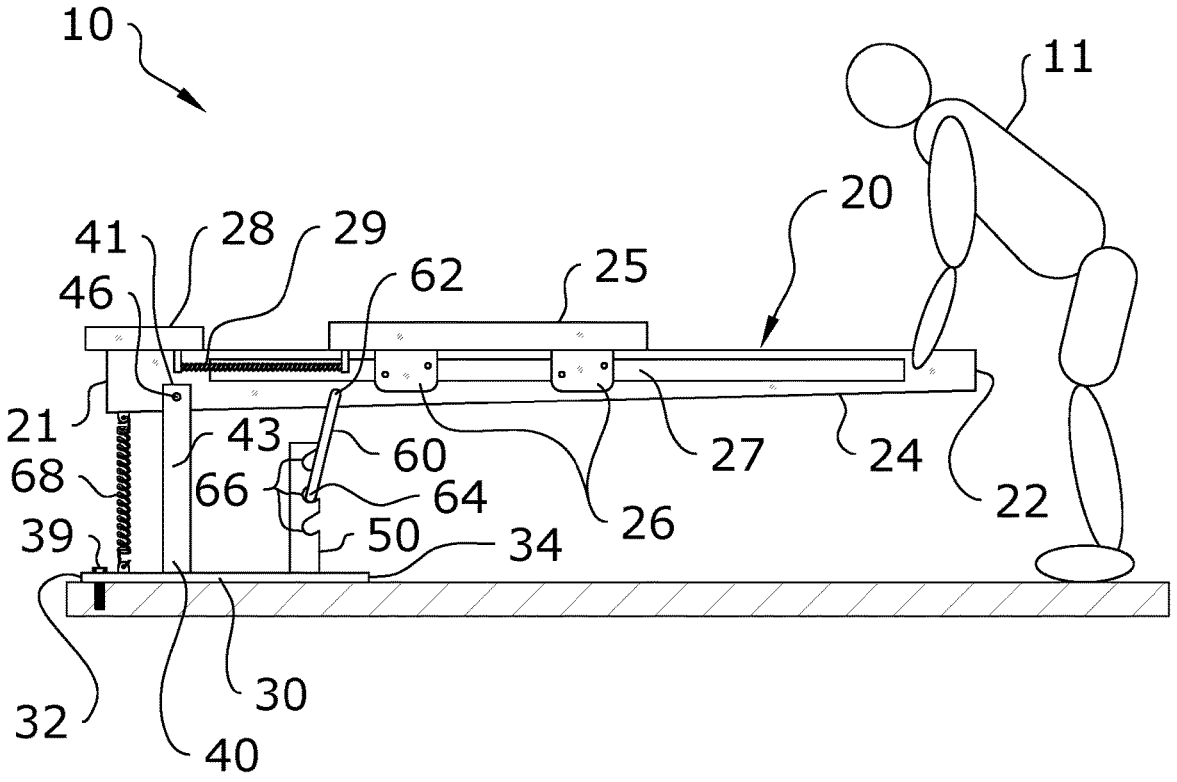
FIG. 18 is a side view of a pawl-based embodiment of the present invention being grasped for adjustment.
Figure 19:
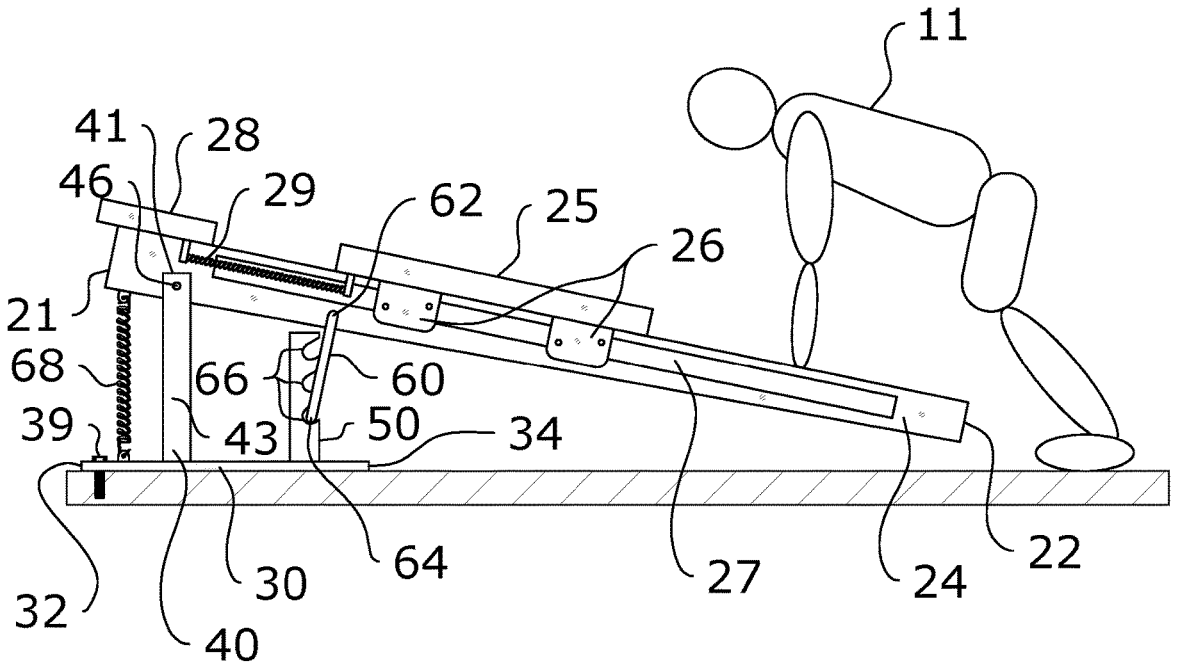
FIG. 19 is a side view of a pawl-based embodiment of the present invention being lowered.

FIGS. 15-16 best show the adjustment device 50 with adjustment notches 66. As shown in the figures, the adjustment device 50 may comprise an elongated member with a plurality of adjustment notches 66 formed therein. The adjustment notches 66 are oriented vertically and are adapted to lockably and removably engage with the locking device 60 of the present invention. The structure, shape, and orientation of the adjustment device 50 and adjustment notches 66 may vary in different embodiments, and should not be construed as limited in scope by the exemplary figures.

As shown in FIG. 15, the locking device 60 extends between the exercise machine 20 and the adjustment device 50 to selectively lock the exercise machine 50 at various angles of incline. The upper end 62 of the locking device 60 is generally secured to the exercise machine 20. The lower end 64 of the locking device 60 is free such that the adjustment device 50 may be rotated about its upper end 62 to aid in positioning. The lower end 64 of the locking device 60 is adapted to selectively engage and lock with the adjustment notches 66 of the adjustment device 50.

To ease the process of adjusting the angle of incline of the exercise machine 20, a counterbalancing bias member 68 may be provided to offset the downwardly-biased weight of the second end 22 of the exercise machine 20. In the figures, a bias member 68 comprised of a spring with sufficient strength is shown to substantially offset the weight of the exercise machine 20. The bias member 68 may be positioned at various locations, but will preferably extend between at or near the first end 32 of the base 30 and at or near the first end 21 of the exercise machine 20.

It should be noted that although an extension spring is shown, the method of counterbalancing the weight of the lever is not limiting. Those skilled in the art will appreciate that other counterbalancing methods may include a torsion spring acting about the fulcrum, a compression spring positioned on the lever side of the fulcrum, pneumatic or hydraulic cylinders, or a counterbalancing weight applied to the structure at the opposed end of the upper assembly relative to the fulcrum. It should be noted that the cantilevered exercise machine 20 is manufactured in such a manner to as to provide stability and longevity of use, and therefore may incorporate structural steel or other heavy materials so that the cantilevered end 22 of the exercise machine 20 is biased downward in a static position.

In use, the angle of the exercise machine 20 may be adjusted before, during, or after performing a set of exercises. To incline or decline the exercise machine 20, the exerciser 11 applies upward pressure on the second end 22 of the exercise machine 20. The bias member 68 aids in applying the upward pressure by reducing the force required by the exerciser 11 to lift the exercise machine 20. The exerciser 11 may easily lift the second end 22, especially since a substantial portion of the weight of the exercise machine 20 is counterbalanced by one or more bias members 68.

When lifted, the locking device 60 may be adjusted to enter any of the adjustment notches 66. Once secured within an adjustment notch 66, the locking device 60 will retain the exercise machine 20 at a given level of incline. When desired, the steps may be repeated to move the locking device 60 into alternate adjustment notches 66 for alternate levels of incline.

Not shown, but as would be obvious to one skilled in the art, a pawl release handle located substantially at the cantilevered end 22 of the exercise machine 20 would easily allow the exerciser 11 to actuate the handle that disengages the locking device 60 from the notch 66 on the adjustment device 50, thereby allowing the exerciser 11 to lower the cantilevered end 22 of the exercise machine 20 to a lowered angle that may be horizontal to the ground surface, or inclined or declined from the horizontal.

iii. Gears.

Figure 20:
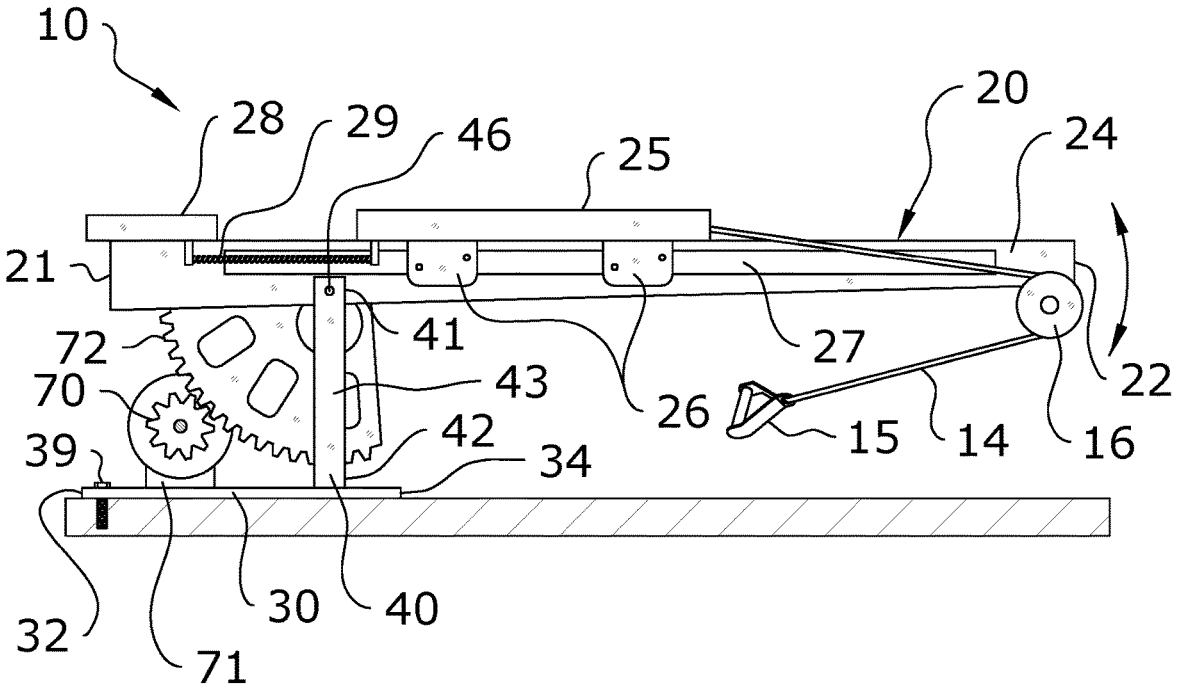
FIG. 20 is a side view of a gear-based embodiment of the present invention in a horizontal orientation.
Figure 21:
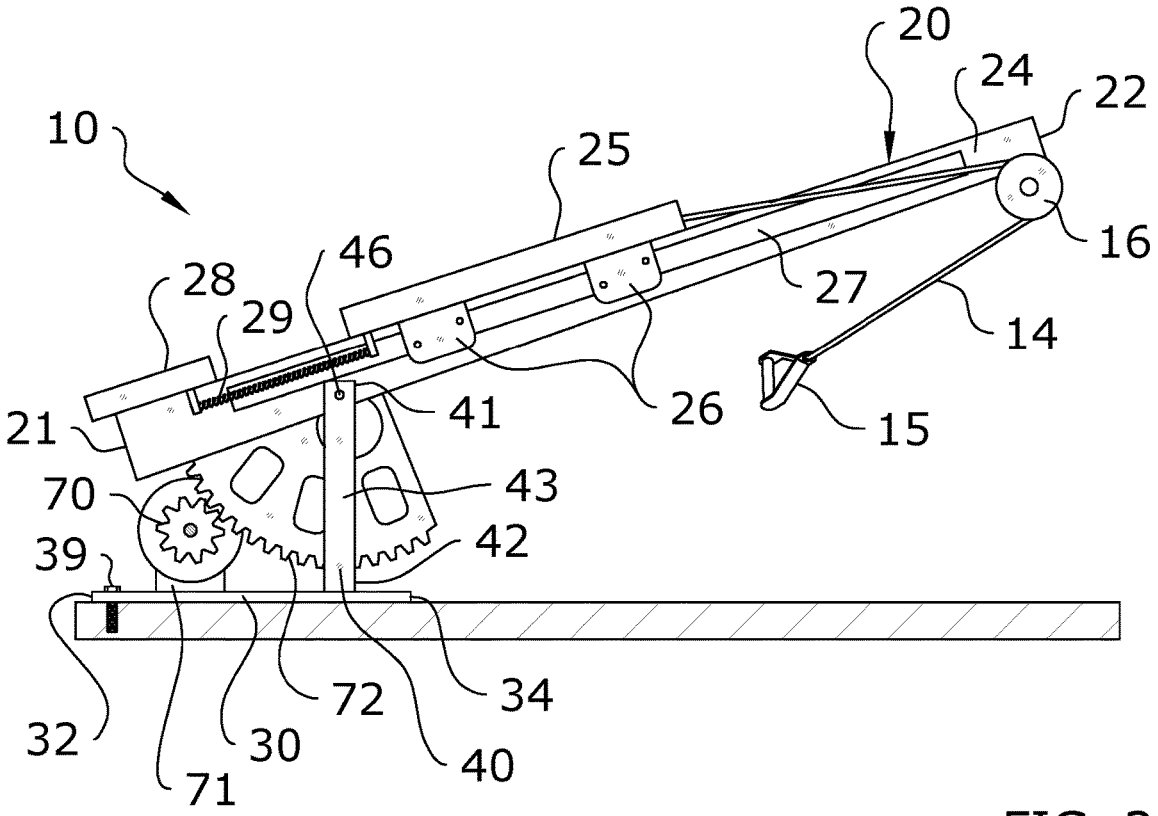
FIG. 21 is a side view of a gear-based embodiment of the present invention in a raised orientation.
Figure 22:
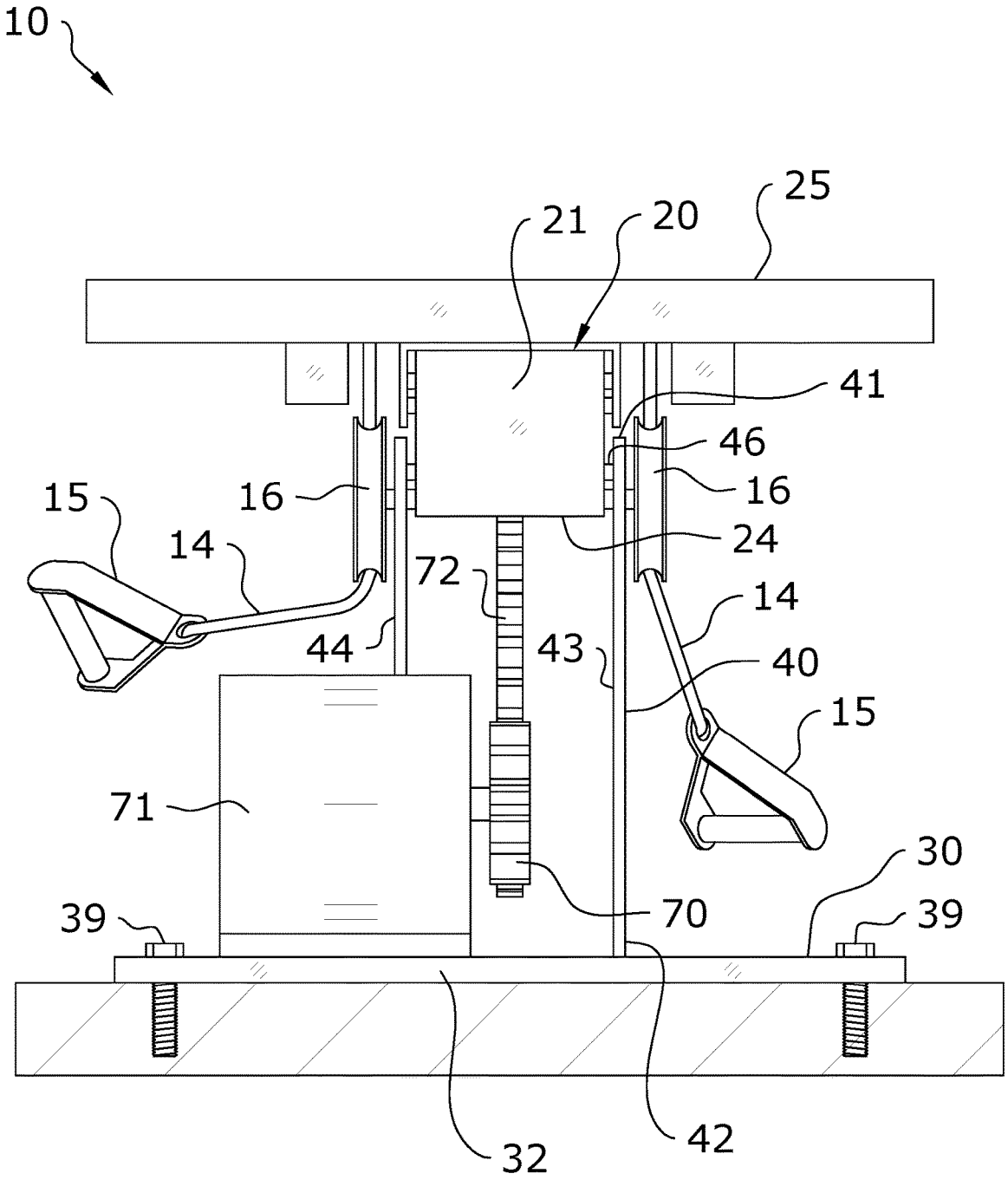
FIG. 22 is a frontal view of a gear-based embodiment of the present invention.

FIGS. 20-22 illustrate an embodiment of the present invention in which the adjustment device 50 comprises one or more gears 70, 72. In this embodiment, the gears 70, 72 are utilized in connection with each other to raise or lower the incline angle of the exercise machine 20.

As shown in the figures, this embodiment of the present invention utilizes an elongated support 40 extending between a point near the second end 34 of the base 30 and the exercise machine 20. The upper end 41 of the support 40 includes the first pivot 46 about which the exercise machine 20 pivots when being adjusted.

The base 30 in this embodiment may include a gear support 71, comprising a base structure on which a first gear 70 is rotatably mounted. A second gear 72 is connected underneath the exercise machine 20 and engages with the first gear 70 as shown in FIG. 20. Rotation of the first gear 70 imparts the rotational motion to the engaged second gear 72, which causes the incline level of the exercise machine 20 to be raised or lowered.

Various types of gears 70, 72 may be utilized. In the figures, the first gear 70 comprises a ring gear comprising a full circular configuration. The second gear 72 comprises a pinion gear which engages with the first gear 70. In order to adjust the angle of the exercise machine 20, a rotational force is applied to either of the gears 70, 72, thereby rotating the other gear 70, 72 and exercise machine 20 about the first pivot 46. It should be noted that the disclosure is not meant to be limiting, and the positioning of the gears 70, 72 may be adjusted or even reversed in some embodiments.

iv. Cam.

FIGS. 23-25 illustrate an embodiment of the present invention in which the adjustment device 50 comprises a cam 74. This embodiment of the present invention utilizes the modified support 40 discussed previously in this disclosure, with the adjustment device 50 extending between the support 40 and the exercise machine 20 (rather than between the base 30 and exercise machine 20 as with other embodiments).

As shown in FIG. 23, the adjustment device 50 in this embodiment comprises a cam 74 which is connected between the support 40 and the exercise machine 20, with the cam 74 resting against the lower surface of the exercise machine 20. The cam 74 is connected to the support 40 by the second pivot 56. The cam 74 contacts the underside of the exercise machine 20, thereby providing the counterbalancing force to support the second end 22 of the exercise machine 20. The figures are not meant to be limiting, and the cam 74 may be rotated by an automated method, such as a motor or linkage, or may be manually operated by an exerciser 11 by turning a crank. A brake (not shown) secures the camshaft, and correspondingly the cam lobe in the desired position until a different inclination or declination angle is desired.

It is preferable to perform some exercises on a substantially horizontal exercise machine 20. However, the present invention introduces the incline or decline of the exercise machine 20 relative to a first pivot 46 so that substantially more exercises, and innumerable variations of traditional exercises can be performed on an inclined or declined plane. Those skilled in the art will appreciate that inclining the second end 22 of the exercise machine 20 will effectively increase the spring resistance force against which the exerciser 11 must apply more force to overcome, and that declining the second end 22 of the exercise machine 20 will effectively decrease the spring resistance force against which the exerciser 11 must apply more force to overcome. Inclining or declining the exercise machine 20 is often preferred to increase or decrease exercise intensity as desired by the exerciser 11 or instructor.

In the figures, the flank of the cam 74 is shown engaging the underside of the exercise machine 20. If the cam 74 is rotated about the second pivot 56 such that the nose of the cam 74 is oriented away from the ground surface, the incline angle of the exercise machine 20 will increase. On the other hand, if the cam 74 is rotated about the second pivot 56 such that the nose of the cam 74 is oriented toward the floor, the incline angle of the exercise machine 20 will decrease.

It should be noted that the heel of the base 30 extends substantially distal from the support 40 in this embodiment, below the exercise machine 20 to counteract the rotational force exerted on the support 40 by a load placed at the second end 22 of the exercise machine 20.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. An exercise machine system, comprising:

an exercise machine having a rail and a carriage movably connected to the rail;

a base positioned underneath the exercise machine;

a support extending upwardly from the base and in a direction different from the rail, wherein the exercise machine is pivotally connected to the support at a pivot point, and wherein the pivot point is located near a first end of the exercise machine; and an adjustment device connected between the base and the exercise machine for pivoting the exercise machine about the support, wherein the adjustment device is connected to the exercise machine between the pivot point and a midpoint of the exercise machine;

wherein an entirety of the adjustment device is located between the pivot point and the midpoint of the exercise machine;

wherein pivoting the exercise machine in a first direction causes the first end of the exercise machine to move upwardly and a second end of the exercise machine to move downwardly, and wherein pivoting the exercise machine in a second direction causes the first end of the exercise machine to move downwardly and the second end of the exercise machine to move upwardly.

2. The exercise machine system of claim 1, wherein the adjustment device is connected to the rail of the exercise machine.

3. The exercise machine system of claim 1, wherein the adjustment device is comprised of an actuator.

4. The exercise machine system of claim 1, wherein the adjustment device is comprised of an electro-mechanical actuator.

5. The exercise machine system of claim 1, wherein the adjustment device is comprised of a hydraulic actuator.

6. The exercise machine system of claim 1, wherein the adjustment device is comprised of a pneumatic actuator.

7. The exercise machine system of claim 1, wherein the adjustment device is comprised of a screw jack.

8. The exercise machine system of claim 1, further comprising an outer cover extending upwardly from the base, wherein the outer cover is positioned around the adjustment device and the support.

9. The exercise machine system of claim 8, wherein the outer cover is comprised of a first side positioned on a first side of the support and a second side positioned on a second side of the support.

10. The exercise machine system of claim 1, wherein the support is comprised of a rigid elongated member.

11. The exercise machine system of claim 10, wherein the rigid elongated member is comprised of a beam or a pipe.

12. An exercise machine system, comprising:

an exercise machine having a rail and a carriage movably connected to the rail;

a base positioned underneath the exercise machine;

a support extending upwardly from the base and in a direction different from the rail, wherein the exercise machine is pivotally connected to the support at a pivot point, and wherein the pivot point is located near a first end of the exercise machine; and an adjustment device connected between the base and the exercise machine for pivoting the exercise machine about the support, wherein the adjustment device is connected to the exercise machine between the pivot point and a midpoint of the exercise machine;

wherein an entirety of the adjustment device is located between the pivot point and the midpoint of the exercise machine;

wherein the adjustment device is comprised of an actuator;

wherein pivoting the exercise machine in a first direction causes the first end of the exercise machine to move upwardly and a second end of the exercise machine to move downwardly, and wherein pivoting the exercise machine in a second direction causes the first end of the exercise machine to move downwardly and the second end of the exercise machine to move upwardly.

13. The exercise machine system of claim 12, wherein the adjustment device is comprised of an electro-mechanical actuator.

14. The exercise machine system of claim 12, wherein the adjustment device is comprised of a hydraulic actuator.

15. An exercise machine system, comprising:

an exercise machine having a rail and a carriage movably connected to the rail;

a base positioned underneath the exercise machine;

a support extending upwardly from the base and in a direction different from the rail, wherein the exercise machine is pivotally connected to the support at a pivot point, and wherein the pivot point is located near a first end of the exercise machine;

wherein the support is comprised of a rigid elongated member;

an adjustment device connected between the base and the exercise machine for pivoting the exercise machine about the support, wherein the adjustment device is connected to the exercise machine between the pivot point and a midpoint of the exercise machine;

wherein an entirety of the adjustment device is located between the pivot point and the midpoint of the exercise machine; and an outer cover extending upwardly from the base, wherein the outer cover is positioned around the adjustment device and the support, and wherein the outer cover is comprised of a first side positioned on a first side of the support and a second side positioned on a second side of the support;

wherein the adjustment device is comprised of an actuator;

wherein pivoting the exercise machine in a first direction causes the first end of the exercise machine to move upwardly and a second end of the exercise machine to move downwardly, and wherein pivoting the exercise machine in a second direction causes the first end of the exercise machine to move downwardly and the second end of the exercise machine to move upwardly.

* * * * *